US011173710B2

(12) United States Patent
Iwasaki

(10) Patent No.: US 11,173,710 B2
(45) Date of Patent: Nov. 16, 2021

(54) IMAGE FORMING APPARATUS AND SIGNAL CONTROL METHOD IN IMAGE FORMING APPARATUS

(71) Applicant: Mitsutaka Iwasaki, Kanagawa (JP)

(72) Inventor: Mitsutaka Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 100 days.

(21) Appl. No.: 16/819,417

(22) Filed: Mar. 16, 2020

(65) Prior Publication Data

US 2020/0298561 A1 Sep. 24, 2020

(30) Foreign Application Priority Data

Mar. 18, 2019 (JP) ..... JP2019-050379

(51) Int. Cl.

| | |
|---|---|
| ***B41J 2/045*** | (2006.01) |
| ***B41J 2/21*** | (2006.01) |
| ***B41J 2/155*** | (2006.01) |
| ***B41J 11/00*** | (2006.01) |
| ***B41J 11/44*** | (2006.01) |

(Continued)

(52) U.S. Cl.

CPC ..... *B41J 2/04573* (2013.01); *B41J 2/155* (2013.01); *B41J 2/16526* (2013.01); *B41J 2/2135* (2013.01); *B41J 2/2146* (2013.01); *B41J 11/008* (2013.01); *B41J 11/0095* (2013.01); *B41J 11/44* (2013.01); *B41J 13/226* (2013.01); *B41J 2025/008* (2013.01)

(58) Field of Classification Search

CPC .... B41J 2/04573; B41J 2/2135; B41J 11/008; B41J 11/44; B41J 11/0095; B41J 2025/008

See application file for complete search history.

(56) References Cited

U.S. PATENT DOCUMENTS 6,883,898 B2 4/2005 Sato
7,914,099 B2 * 3/2011 Loh ..... B41J 29/38 347/16

(Continued)

FOREIGN PATENT DOCUMENTS

EP 1547771 A1 * 6/2005 ..... B41L 23/20
EP 3705303 A1 * 9/2020 ..... B41J 11/46

(Continued)

*Primary Examiner* — Julian D Huffman

(74) *Attorney, Agent, or Firm* — IPUSA, PLLC

(57) ABSTRACT

An image forming apparatus includes a rotational conveying unit for conveying a recording medium by rotating about a rotational axis. A head unit includes n nozzle rows in a conveying direction perpendicular to an axial direction parallel to the rotational axis. Each of the n nozzle rows includes nozzles aligned as a nozzle row in the axial direction. Each n nozzle row is arranged at a distance of d1 to d(n−1) from a predetermined reference nozzle row. A circuit outputs a rotational amount detection signal, and a conveying amount detection signal, and generates a discharge synchronization signal based on the detected rotational amount detection signal and the detected conveying amount detection signal, then generates a nozzle row timing signal based on the distance of the d1 to d(n−1) and the discharge synchronization signal, and generates discharge data based on the discharge synchronization signal and the nozzle row timing signal.

9 Claims, 19 Drawing Sheets

(51) Int. Cl.

| | |
|---|---|
| ***B41J 2/165*** | (2006.01) |
| ***B41J 13/22*** | (2006.01) |
| ***B41J 25/00*** | (2006.01) |

(56) References Cited

U.S. PATENT DOCUMENTS

| | | | | |
|---|---|---|---|---|
| 9,688,071 | B2 | 6/2017 | Saito | |
| 2005/0035998 | A1 | 2/2005 | Ando et al. | |
| 2012/0098879 | A1* | 4/2012 | Mandel | B65H 7/08 347/16 |
| 2018/0272758 | A1* | 9/2018 | Hori | B41J 11/0095 |
| 2019/0283398 | A1* | 9/2019 | Maeyama | B41J 13/223 |
| 2020/0282749 | A1* | 9/2020 | Imamura | B41J 2/2117 |
| 2020/0290342 | A1* | 9/2020 | Yoda | B41J 2/17513 |
| 2020/0307278 | A1* | 10/2020 | Yamada | B65H 18/145 |

FOREIGN PATENT DOCUMENTS

| | | |
|---|---|---|
| JP | H07-123276 | 5/1995 |
| JP | 2002-192712 | 7/2002 |
| JP | 2003-136728 | 5/2003 |
| JP | 2017-001385 | 1/2017 |

* cited by examiner

IMAGE FORMING APPARATUS AND SIGNAL CONTROL METHOD IN IMAGE FORMING APPARATUS

CROSS-REFERENCE TO RELATED APPLICATION

The present application is based on and claims priority to Japanese Priority Application No. 2019-050379 filed on Mar. 18, 2019, the entire contents of which are hereby incorporated herein by reference.

BACKGROUND OF THE INVENTION

1. Field of the Invention

The present invention relates to an image forming apparatus and a signal control method in an image forming apparatus.

2. Description of the Related Art

Conventionally, an image forming apparatus is known in which multiple heads including one or two rows of nozzle (nozzle rows) for discharging ink for each color of ink used for image forming are arranged in a direction perpendicular to a conveying direction in a staggered manner.

In such an image forming apparatus, discharge timing control is known that uses a timing depending on a constant conveying distance and position information in the conveying direction of a nozzle row, for example, as disclosed in Japanese Examined Patent Application Publication No. 7-123276 and Japanese Unexamined Patent Application Publication No. 2002-192712.

In recent years, various types of heads have been used in the above-described image forming apparatus. For example, there is a superimposed head having two heads in the conveying direction and a head having four rows of nozzles, for example, as disclosed in Japanese Unexamined Patent Application Publication No. 2003-136728.

Some superimposed heads are shifted in a direction perpendicular to the conveying direction in order to increase the resolution, while others are shifted in a direction in which the nozzle rows of overlapping heads intersect the conveying direction.

Thus, because various types of heads have been used, control of a timing of discharging ink from the nozzle becomes complicated.

Moreover, when a variety of heads is introduced, such as heads including three or more heads overlapped in the conveying direction or heads including overlapped five or six rows of nozzles, in the conventional discharge timing control using information only about a timing corresponding to a certain conveying distance and a position in the conveying direction of the nozzle rows, the accuracy of the discharge position of the image formed on a recording medium is decreased.

SUMMARY OF THE INVENTION

Accordingly, embodiments of the present disclosure may provide an image forming apparatus and a signal control method in an image, forming apparatus reducing one or more of the above-described problems.

More specifically, the embodiments of the present invention may provide an image forming apparatus that can increase accuracy of a discharge position and prevent a deterioration of the quality of an image even in a configuration including some nozzle rows each extending in an axial direction and disposed in a conveying direction in a head unit.

According to an embodiment of the present disclosure, there is provided an image forming apparatus that includes a rotational conveying unit including a gripping member configured to grip a recording medium, the rotational conveying unit being configured to convey the recording medium by rotating about a rotational axis while gripping the recording medium by the gripping member. At least one head unit includes n nozzle rows in a conveying direction perpendicular to an axial direction parallel to the rotational axis. Here, n is a natural number. Each of the n nozzle rows includes a plurality of nozzles each aligned as a nozzle row in the axial direction. Each of the nozzles is configured to discharge an ink drop onto the recording medium. Each of the n nozzle rows is arranged at a distance of d1 to d(n−1) from a predetermined reference nozzle row. A circuit is configured to detect a rotational amount of the rotational conveying unit and to output a rotational amount detection signal, to detect a conveying amount of the recording medium by the rotational conveying unit and to output a conveying amount detection signal, to generate a discharge synchronization signal based on the detected rotational amount detection signal and the detected conveying amount detection signal, to generate a nozzle row timing signal indicating a discharge timing from each of the n nozzle rows at a different timing for each of then nozzle rows based on the distance of the d1 to d (n−1) and the discharge synchronization signal, the distance of the d1 to d(n−1) being arrangement information of the n nozzle rows in the at least one head unit, and to generate discharge data for each of the n nozzle rows based on the discharge synchronization signal and the nozzle row timing signal.

Other objects, features and advantages of the present invention will become more apparent from the following detailed description when read in conjunction with the accompanying drawings.

DETAILED DESCRIPTION OF THE PREFERRED EMBODIMENTS

Figure 1:
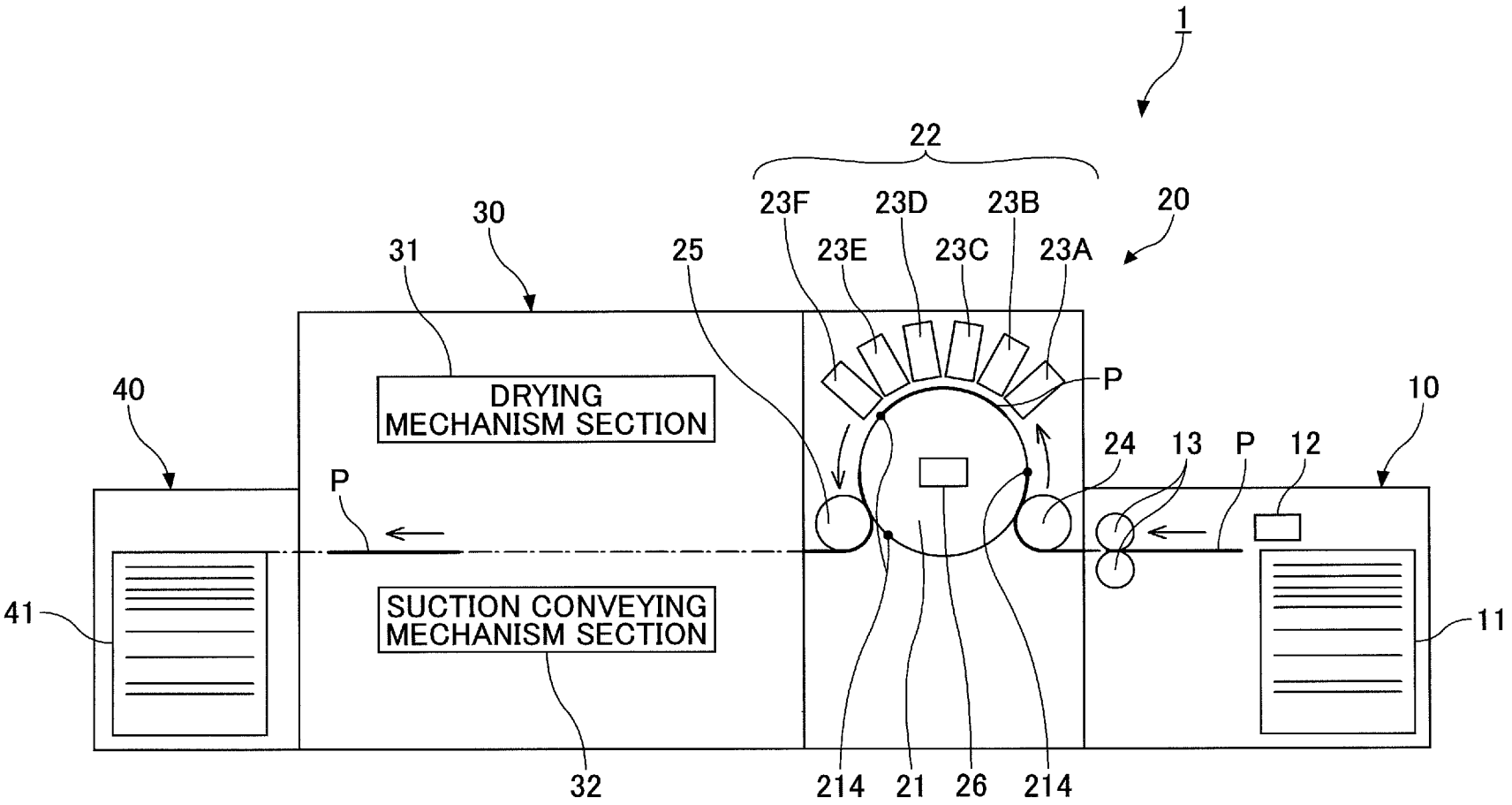
FIG. 1 is a schematic view illustrating an image forming apparatus according to a first embodiment of the invention.

Hereinafter, an embodiment for carrying out the present disclosure with reference to the drawings will be described. In each drawing, the same components are indicated by the same reference numerals and overlapping descriptions may be omitted.

<Printing Device>

FIG. 1 is a schematic side view illustrating an example of an image forming apparatus according to a first embodiment of the present disclosure. In FIG. 1, a printing device 1 includes a carry-in section 10, a printing section 20, a drying section 30, and a carry-out section 40. The printing device 1 applies ink (ink drops or a liquid) to a sheet material P, which is a sheet-shaped member (recording medium) that is carried in from the carry-in section 10, and performs the necessary printing. After the ink adhering to the sheet material P is dried by the drying section 30, the sheet material P is discharged to the carry-out section 40.

The carry-in section 10 includes a carry-in tray 11 on which a plurality of sheet materials P is stacked, a feeder 12 to separate each sheet material P from the carry-in tray 11 and to send out each sheet material P, and a pair of resist rollers 13 to send the sheet materials P to the printing section 20.

The feeder 12 may be any feeder, such as a device using a roller or a device utilizing air suction. The sheet material P fed from the carry-in tray 11 by the feeder 12 is fed to the printing section 20 by driving the pair of resist rollers 13 at a predetermined timing after the leading end thereof reaches the pair of resist rollers 13.

The printing section 20 includes a conveying drum 21 as a conveying unit for conveying the sheet material P while holding the sheet material P on the outer circumferential surface, and a liquid discharge section 22 for discharging ink (liquid) toward the sheet material P held by the conveying drum 21.

The printing section 20 includes a transfer drum 24 for receiving the sent sheet material P and delivering the sheet material P to the conveying drum 21 and a transfer drum 25 for delivering the sheet material P conveyed by the conveying drum 21 to the drying section 30.

The sheet material P, which has been conveyed from the carry-in section 10 to the printing section 20, is supported at the front end by a gripping member provided on the surface of the transfer drum 24 and conveyed as the transfer drum 24 rotates. The sheet material P conveyed by the transfer drum 24 is fed to the conveying drum 21 at a position facing the conveying drum 21. A gripping member 214—such as a sheet gripper, is also provided on the surface of the conveying drum 21, and the leading end of the sheet material P is gripped by the gripping member 214. On the surface of the conveying drum 21, a plurality of suction holes is dispersedly formed. A suction apparatus 26, which is a suction means, generates a suction air stream inwardly from the suction hole of the conveying drum 21.

The sheet material P received from the transfer drum 24 to the conveying drum 21 is gripped by the gripping member 214, adsorbed on the conveying drum 21 by the suction airflow by the suction device 26, and conveyed as the conveying drum 21 rotates.

The liquid discharge section 22 includes a discharge unit 23 (23A to 23F) that is a liquid discharging means. For example, the discharge unit 23A discharges cyan (C); the discharge unit 23B discharges magenta (M) ink; the discharge unit 23C discharges yellow (Y) ink; and the discharge unit 23D discharges black (K) ink. The discharge units 23E and 23F are used to discharge any of YMCK or special ink such as white, gold and silver. Further, the discharge unit for discharging the treatment liquid, such as the surface coating liquid, can be provided. The details of the discharge unit 23 are described later with reference to FIG. 2.

The drying section 30 includes a drying mechanism section 31 for drying the ink adhering to the sheet material P at the printing section 20 and a suction and conveying mechanism section 32 for conveying the sheet material P conveyed from the printing section 20 while suction the sheet material P (conveyed while suctioning).

The sheet material P, which has been conveyed from the printing section 20, is received by the suction and conveying mechanism section 32, conveyed to pass through the drying mechanism section 31, and is transferred to the carry-out section 40.

When the sheet material P passes through the drying mechanism 31, the ink on the sheet material P is dried. As a result, the liquid such as moisture in the ink evaporates, the coloring agent contained in the ink fixes on the sheet material P, and a curl of the sheet material P is inhibited.

The carry-out section 40 includes a carry-out tray 41 on which a plurality of sheet materials P is stacked. The sheet material P conveyed from the drying section 30 is sequentially stacked and retained on the carry-out tray 41.

In the printing device 1, for example, a pre-processing section that performs a pretreatment on the sheet material P can be disposed upstream of the printing section 20, or a post-processing section that performs a posttreatment on the sheet material P to which ink adheres can be disposed between the drying section 30 and the carry-out section 40.

As a pretreatment section, for example, a pre-coating treatment is cited as an example in which a treatment liquid to reduce blistering by reacting with ink is applied to the sheet material P. Further, the posttreatment section includes, for example, a sheet reverse transfer treatment to print one side of the sheet material P at the printing section 20 and then to print the other side of the sheet material by reversing the one-side printed sheet material P and sending the sheet material P back to the printing section 20 again, and a process for binding a plurality of sheets.

<Discharge Unit>

Figure 2:
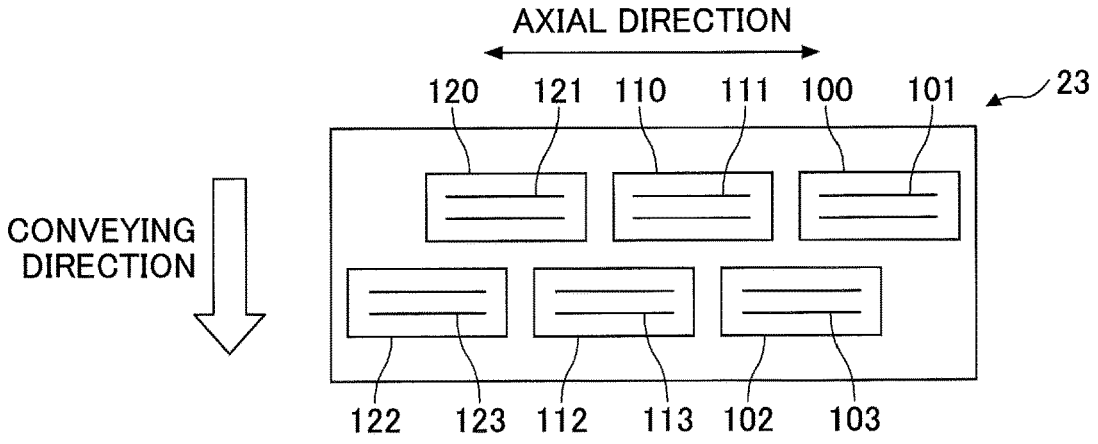
FIG. 2 is a plan view illustrating an example of a head unit included in an image forming unit in FIG. 1.

Next, the bottom surface configuration of the discharge unit (head unit) will be described with reference to FIG. 2. FIG. 2 is a plan view (top view) illustrating an example of a head unit included in an image forming section in FIG. 1.

For example, as illustrated in FIG. 2, the discharge unit 23 is a full line type head in which a plurality of liquid discharge heads (hereinafter, simply referred to as "heads") 100 each including nozzle rows 101 constituted of a plurality of arranged nozzles, are disposed on a base member.

In the present example, two rows of heads are provided in the discharge unit 23 in the conveying direction. Specifically, the head 100, the head 110, and the head 120, and the head 102, the head 112, and the head 122 are arranged in rows in the axial direction of the discharge unit 23. The head 100 (110,120) and the head 102 (112,122) are arranged axially in a zigzag array of two rows of heads.

The discharge operation of each discharge unit 23 of the liquid discharge unit 22 is controlled by a drive signal corresponding to the print information. When the sheet material P supported on the conveying drum 21 passes through a region facing the liquid discharge unit 22, ink of each color is discharged from the discharge unit 23, and an image corresponding to the printing information is printed.

<Detector>

Figure 3:
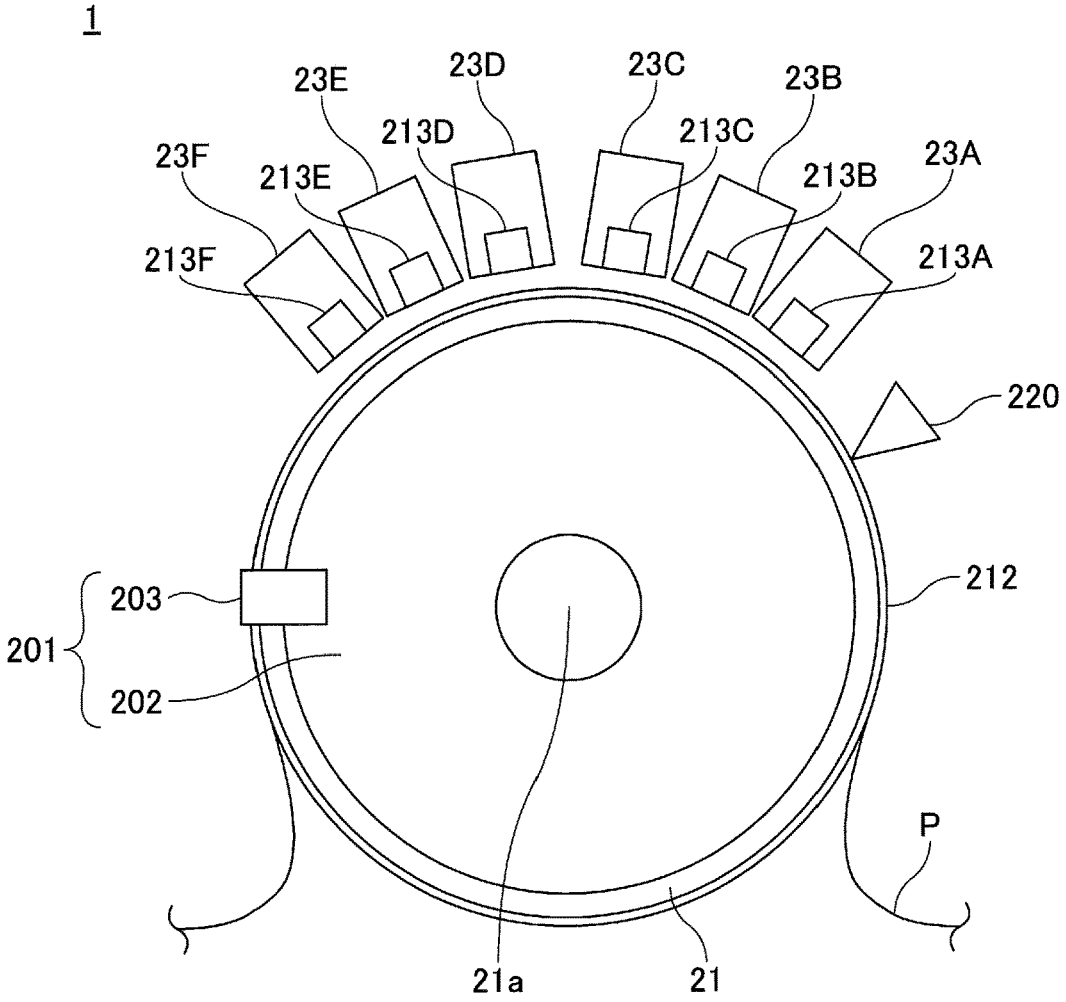
FIG. 3 is a front view of a transfer drum and a liquid discharge unit illustrated in FIG. 1.
Figure 4:
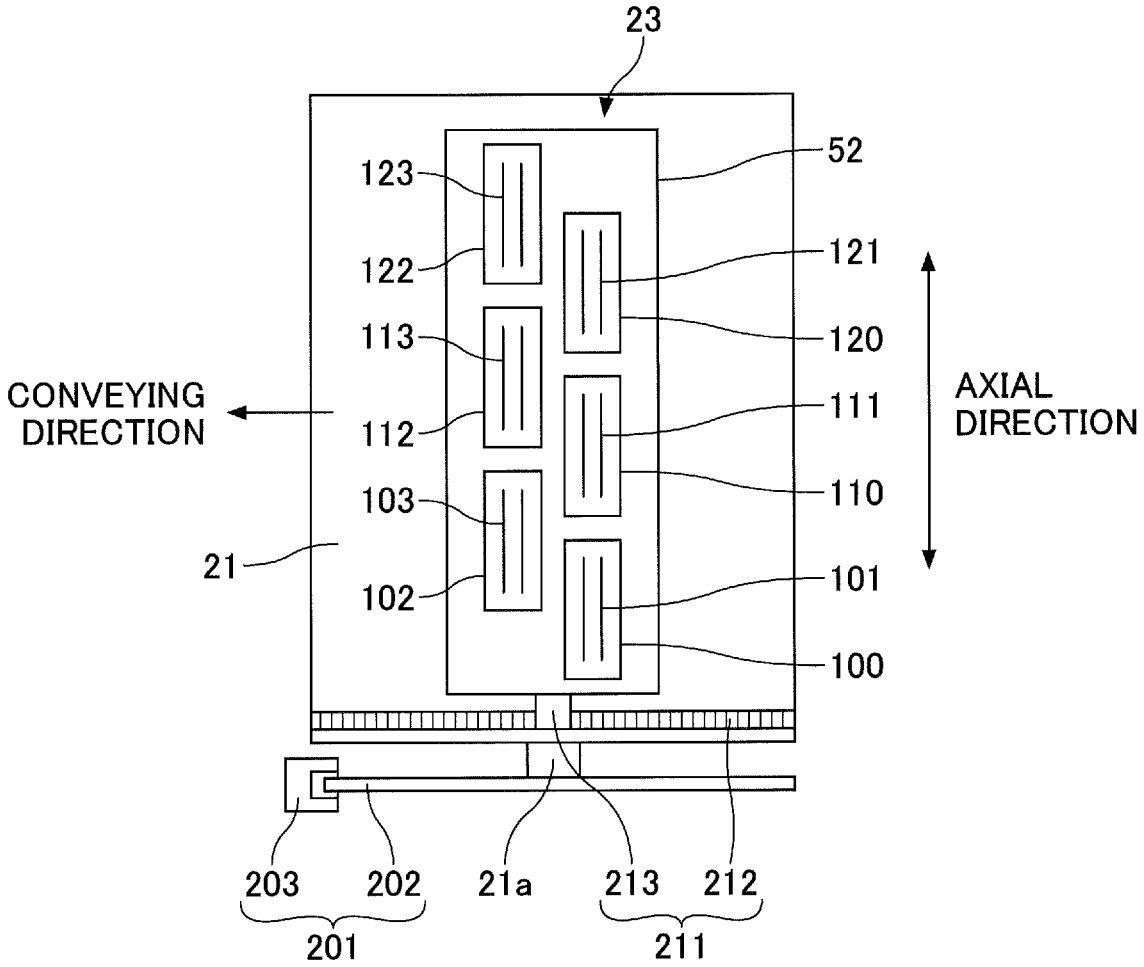
FIG. 4 is a plan view of one of a transfer drum and a liquid discharge unit illustrated in FIG. 1.

Next, a detection portion for performing the discharge timing control according to the present embodiment will be described with reference to FIGS. 3 and 4. FIG. 3 is an explanatory front view around a conveying drum, and similarly, FIG. 4 is an explanatory plan view. However, FIG. 4 illustrates a single discharge unit for simplification. As illustrated in FIG. 4, in the discharge unit 23, a plurality of heads zigzags in the same manner as in FIG. 2.

An encoder wheel 202 is provided on a shaft 21*a* of the conveying drum 21, and an encoder sensor 203 for reading an encoder wheel 202 is disposed. The encoder wheel 202 and the encoder sensor 203 constitute a first encoder 201 that is a first signal output unit (a first detection unit). The first encoder 201 is a rotary encoder and outputs a first signal (a rotational amount detection signal) that is an output pulse according to a rotational amount (a rotational driving amount) of the conveying drum 21.

An encoder scale 212 is provided to a circumferential surface of the conveying drum 21, and an encoder sensor 213 for reading the encoder scale 212 is disposed. The encoder scale 212 and the encoder sensor 213 constitute the second encoder 211 that is a second signal output unit (a second detection unit). The second encoder 211 is a linear encoder and outputs a second signal (conveying amount detection signal) that is an output pulse according to the movement amount of the circumferential surface of the conveying drum 21, and the second signal is a signal that is correlated with the conveying amount of the sheet material P conveyed by the conveying drum 21.

Here, the encoder sensor 213 constituting the second encoder 211 is disposed in the vicinity of each of the plurality of discharge units 23. In the present embodiment, the encoder sensor 213 is attached to the base member 52 of the discharge unit 23. Accordingly, the encoder sensor 213 of each discharge unit 23 and the encoder scale 212 of the conveying drum 21 constitute each second encoder 211.

Specifically, encoder sensors 213A to 213F (which are, hereinafter, generally, referred to as encoder sensors 213) are provided in the discharge units 23 of respective colors, and form detection devices indicating the positions of the respective discharge units 23A to 23F. When the position information of the first encoder 201 actually detects the sheet material P and the information of the second encoder 211 representing the positions at which the discharge units 23A to 23F are facing each other on the outer circumferential surface of the conveying drum 21 are combined with each other, the timing of the period during which the sheet material P faces each of the discharge units 23A to 23F can be detected.

Further, a sheet material position sensor 220, which is a sheet material position detecting unit that detects the leading end of the sheet material P, is disposed upstream of the discharge unit 23A having the most upstream position in the conveying direction of the sheet material P.

In the present embodiment, the sheet material position sensor 220 detects the leading end of the sheet material P, but may be configured to read resist marks used for aligning the sheet material P. By using a structure that reads the resist marks, it is possible to handle not only the cut sheet material but also the case of using continuous media such as continuous-feed paper.

<Hardware Block>

Figure 5:
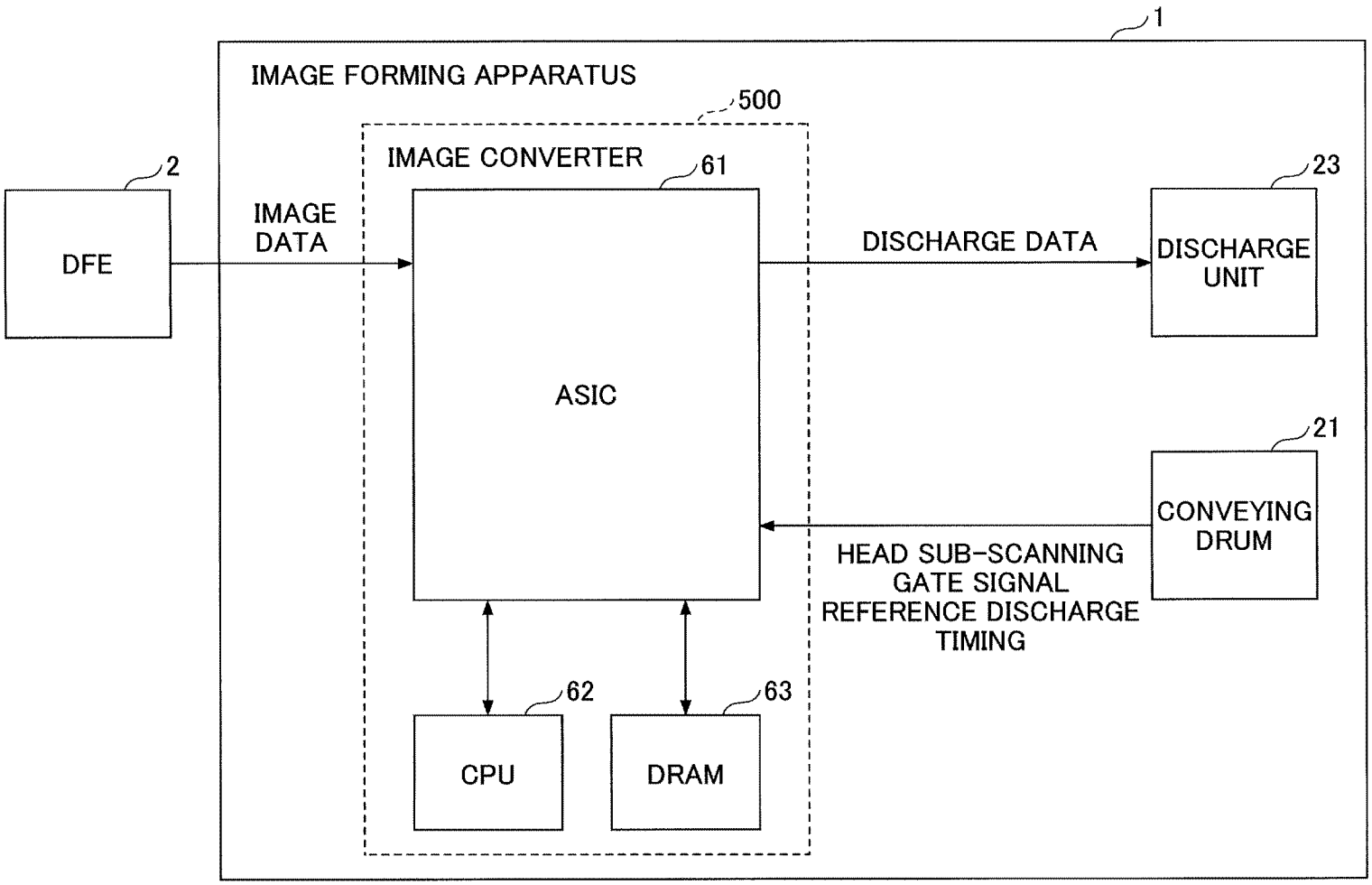
FIG. 5 is a schematic hardware block diagram of a portion of signal generation in a system including an image forming apparatus illustrated in FIG. 1.

FIG. 5 is a schematic hardware block diagram of a portion relating to signal generation in a system including the image forming apparatus of FIG. 1.

Referring to FIG. 5, a DFE (Digital Front End) 2 that is a high-level device is connected to the image forming apparatus 1. The DFE 2 digitally processes image signal correction, pixel rearrangement and the like, thereby generating image data.

The image forming apparatus 1 includes an image converter 500, a discharge unit 23, and a conveying drum 21 as a part related to signal generation of the present disclosure. The discharge unit 23 is a generic term for a plurality of discharge units 23A to 23F.

The image converter 500 includes an ASIC (Application Specific Integrated Circuit) 61, a CPU (Central Processing Unit) 62, and a DRAM (Dynamic Random Access Memory) 63. The ASIC 61 primarily converts the image to generate discharge data; the DRAM 63 temporarily stores the image data; and the CPU 62 controls the ASIC 61.

The image converter 500 receives the image data from the DFE 2, generates the discharge data using the gate signal from the conveying drum 21 and the discharge timing, and outputs the discharge data to the discharge unit 23.

<Signal Generation and Discharge Control Block>

Figure 6:
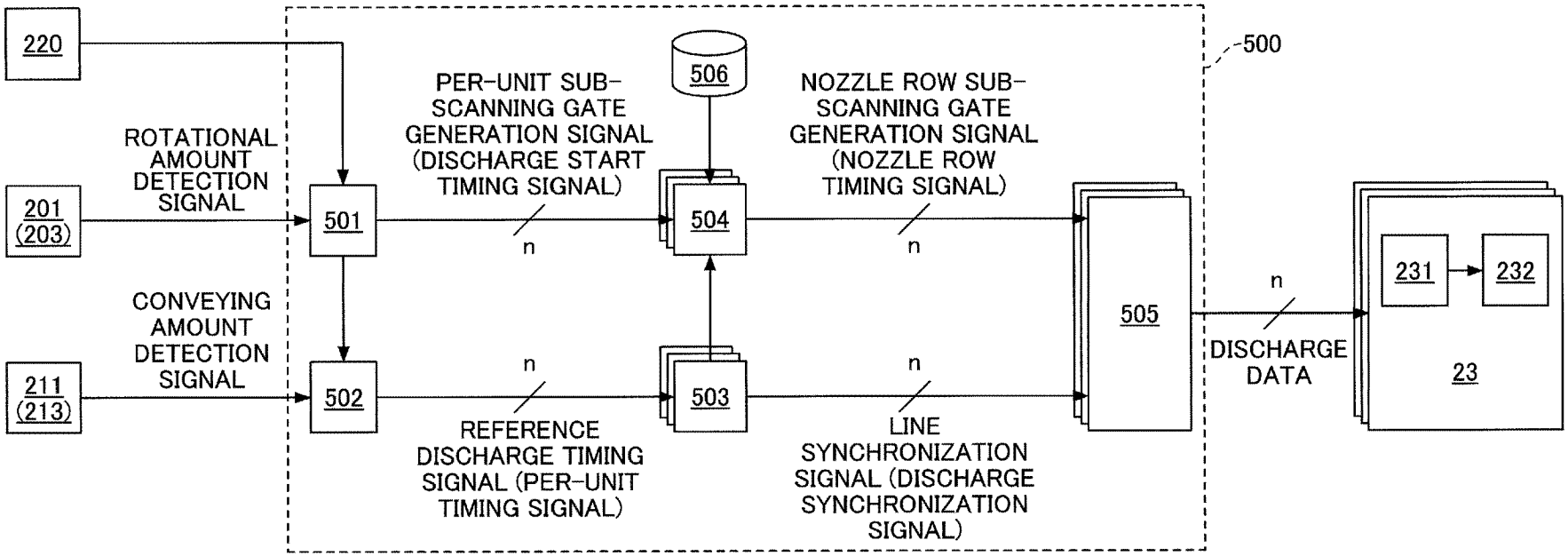
FIG. 6 is a detailed block diagram illustrating signal generation and discharge control according to a first embodiment of the present invention.

Next, the portion related to the discharge timing control will be described with reference to a block explanatory diagram in FIG. 6. FIG. 6 is a detailed block diagram illustrating signal generation and discharge control according to the first embodiment of the present disclosure.

The image converter 500 includes a head sub-scanning gate signal generator 501, a reference discharge timing generator 502, a line synchronization signal generator 503, a nozzle row sub-scanning gate generator 504, and a head drive controller 505. These functions are performed in the ASIC 61 or the CPU 62 illustrated in FIG. 5. The image converter 500 serves as a controller that controls the discharge unit 23.

The head sub-scanning gate signal generator 501 counts the output pulses that are the first signal (an example of the rotational amount detection signal) from the first encoder 201 from a state in which the sheet material position sensor 220 detects the leading end position of the sheet material P and determines the discharge start timing. The head sub-scanning gate signal generator 501 generates the sub-scanning gate signal for each unit as the discharge start timing for each color, that is, for each discharge unit 23. The determination and generation of the discharge start timing are described in detail with reference to FIG. 7.

The reference discharge timing generator 502 generates the discharge timing after discharge at the discharge start timing determined by the head sub-scanning gate signal generator 501 based on the output pulse that is the second signal (an example of the conveying amount detection signal) of the second encoder 211. The generated signal is used as a reference discharge timing signal and is generated for each color, that is, for each discharge unit 23.

The line synchronization signal generator 503 (an example of a synchronization signal generator) generates a line synchronization signal (an example of a discharge synchronization signal) that defines the discharge timing for each nozzle row provided in the heads of each discharge unit 23. The generation of the discharge synchronization signal will be described later with reference to FIG. 8.

The nozzle row sub-scanning gate generator 504 (an example of the discharge timing generator) generates a nozzle row sub-scanning gate generating signal (an example of the nozzle row timing signal) that is a gate corresponding to the discharge start timing and the number of lines of the effective image for each nozzle row 101 provided in each head 100 of the discharge unit 23. The nozzle row sub-scanning gate generator 504 generates a nozzle row timing signal, which is a timing signal for each nozzle row, using a per-unit discharge timing signal, which is an output of the head sub-scanning gate signal generator 501, a line synchronization signal, which is an output of the line synchronization signal generator 503 (an example of a discharge synchronization signal), and information about a nozzle row arrangement and an adjustment line stored in the nozzle row arrangement information/adjustment line storage unit 506. The generation of nozzle row timing signals is described in detail below with reference to FIGS. 9 to 11.

The head drive controller 505 (an example of the drive controller) inputs image data transmitted from the DFE 2. The head drive controller 505 generates and outputs the discharge data at a timing based on the nozzle row sub-scanning gate signal (nozzle row timing signal) that is the output of the nozzle row sub-scanning gate generator 504 and the line synchronization signal that is the output of the line synchronization signal generator 503.

Each discharge unit 23 includes a head driver 231 and a pressure generator 232. The head driver 231 generates a drive waveform based on the discharge data and applies the drive waveform to the pressure generator 232. The pressure generator 232 applies pressure to the ink in the nozzle depending on the driving waveform and discharges the ink.

Specifically, the head drive controller 505 generates discharge data at a timing when the line synchronization signal generated by the line synchronization signal generator 503 is H during a period of time when the nozzle row sub-scanning gate from the nozzle row sub-scanning gate generator 504 is H.

Thus, the discharge accuracy between the same colors, which requires high accuracy, can be defined by the position of the actual sheet material P on the conveying drum 21 obtained by the second encoder 211. On this occasion, the second encoder 211 detects the conveying amount of the sheet material P conveyed by the conveying drum 21, and can reduce errors due to the rotation accuracy of the conveying drum 21 and the component accuracy of the conveying drum 21. Therefore, even if a highly precise encoder is not used for the first encoder 201 for directly detecting the rotational amount of the conveying drum 21, a highly precise landing position accuracy can be obtained, and print quality is improved.

<Generation of Per-Unit Discharge Timing>

Next, the determination (generation) of the discharge start timing in any one color of the discharge unit 23 (head unit) after the timing signal from the sheet material position sensor 220 is generated will be described. The same timing generation method applies to the heads of the other colors.

Figure 7:
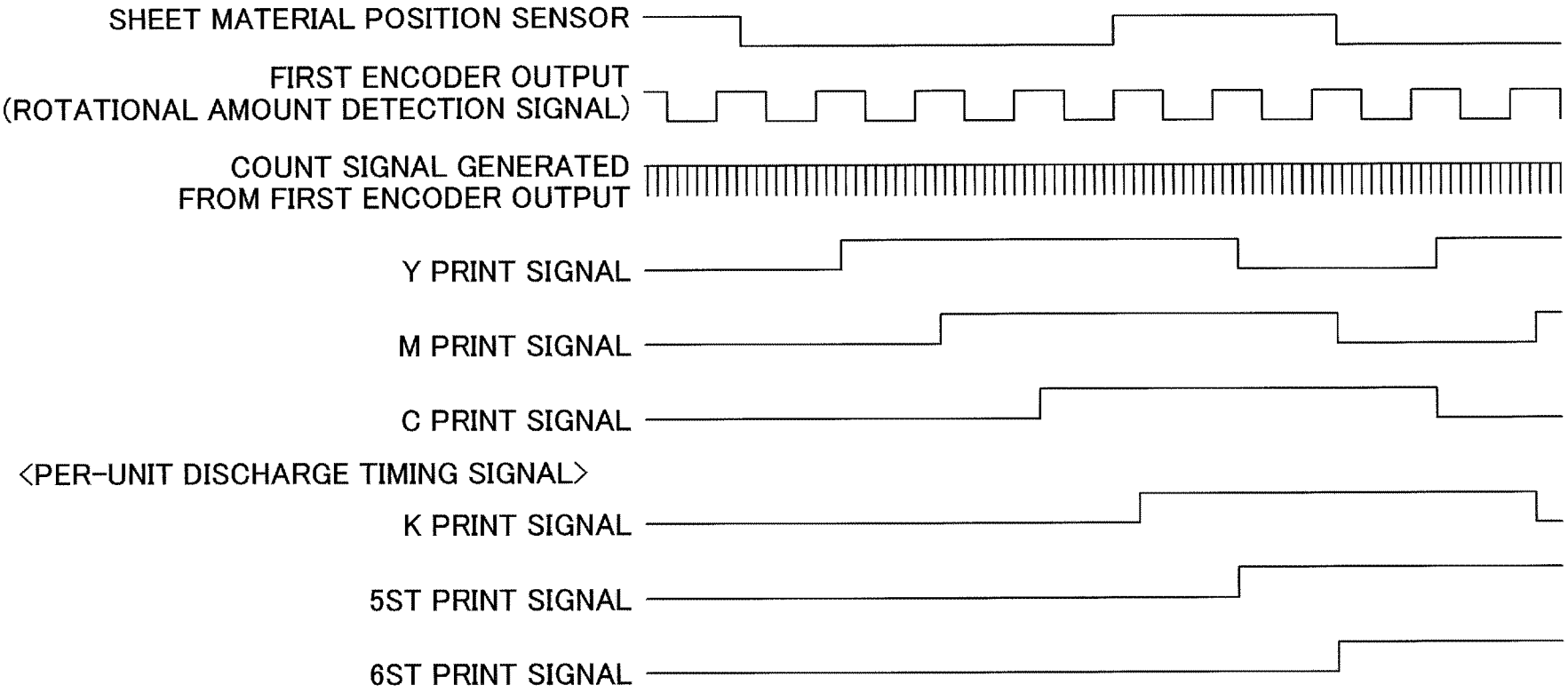
FIG. 7 is a timing chart explaining a speed detection signal and a discharge timing of each color.

Here, the determination of the discharge start timing for each color in the head sub-scanning gate signal generator 501 using the first signal (rotational amount detection signal) of the first encoder 201 will be described with reference to the timing chart of FIG. 7. FIG. 7 is a timing chart explaining a rotational amount detection signal and the discharge timing of each color.

When the sheet material P is transferred to the conveying drum 21 by the transfer drum 24, the suction device 26 starts suctioning the sheet material P, and the conveying drum 21 conveys the sheet material P by the rotation. Then, when the sheet material position sensor 220 detects the leading end of the sheet material P and then the drop of the output (L), the count of the count signal obtained by multiplying the output of the first encoder 201 is started.

When the count reaches a predetermined value corresponding to the physical distance of the discharge units 23A to 23F of each color, the head sub-scanning gate signal generator 501 outputs a print signal (head sub-scanning gate signal, per-unit discharge timing signal) of each color. In FIG. 7, the 5ST print signal corresponds to the ink of a specific color discharged by the discharge unit 23E, and the 6ST print signal corresponds to the ink of a specific color discharged by the discharge unit 23F.

As described above, after the discharge start timing signal for each color is output, ink is discharged from the head 100 of the discharge unit 23 corresponding to each color. On this occasion, discharge is performed at the timing of the discharge timing signal generated based on the second signal (conveying amount detection signal) of the second encoder 211.

Next, the timing of discharge by the head of one color after the timing signal for each color is generated will be described. The same timing generation method applies to the heads of the other colors.

<Generation of Line Synchronization Signal (Discharge Synchronization Signal)>

Figure 8:
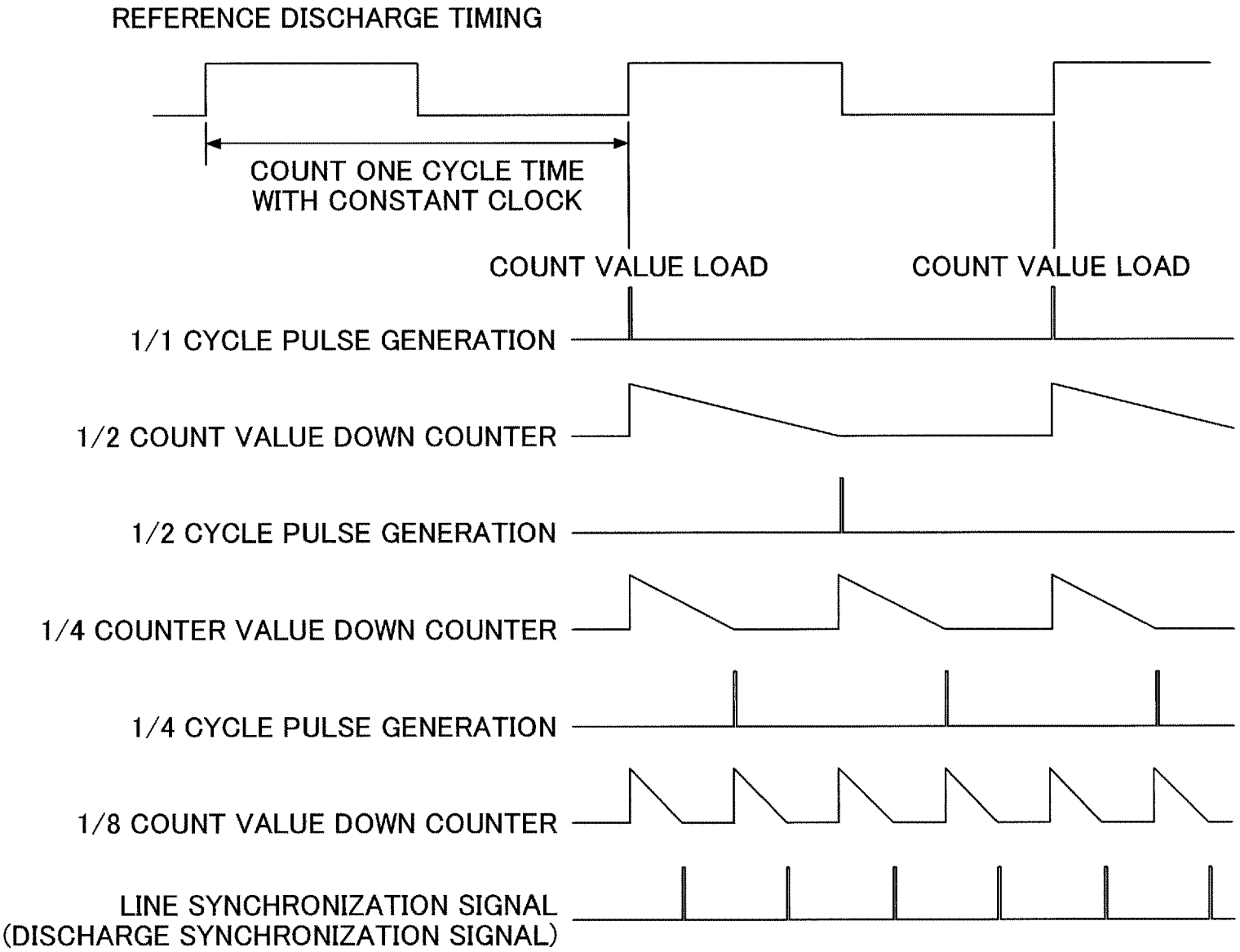
FIG. 8 is an explanatory diagram illustrating generation of a line synchronization signal from a reference discharge timing signal.

FIG. 8 illustrates the generation of the line synchronization signal (discharge synchronization signal) that is the third signal from the second signal (conveying amount detection signal) that is the output of the second encoder 211. Logical circuits are typically designed using an internal clock with a constant frequency, such as a clock generated in a PLL (Phase Locked Loop).

Here, the frequency of the internal clock is required to be sufficiently higher than the frequency of the second signal (the conveying amount detection signal).

In the present configuration, each cycle of the reference discharge timing signal generated based on the conveying amount detection signal is counted by an internal clock. The count value is stored and a 1/1 cycle pulse is generated simultaneously. In addition, 1/2, 1/4, and 1/8 of the saved count values are calculated; a down counter is provided from each value; and a pulse is generated when the counter is 0. Each down count starts at the previous timing, that is, 1/1 cycle pulse for 1/2 down counts and 1/4 cycle pulse for 1/8 down counts.

The 1/1, 1/2, 1/4 and 1/8 cycle pulses generated in this manner are synthesized, and a line synchronization signal, which is a discharge synchronization signal, is generated.

As described in FIG. 6, the second signal (the conveying detection signal) output from the second encoder 211 has a cycle depending on the conveying amount (the moving amount) of the sheet material P conveyed by the surface of the conveying drum 21. Accordingly, the reference discharge timing signal is generated by reflecting the discharge timing signal depending on the sheet position detected by the sheet material position sensor 220 and the rotational amount of the conveying drum 21, and information on the medium conveying amount that is the detection result of the detection devices 213A to 213F (see FIG. 3) for each unit of the second encoder 211. Therefore, the reference discharge timing signal reflects the information of the rotational amount detection signal and the conveying amount information of the medium at the position reaching each discharge unit 23A to 23F, and thus becomes a signal for each unit (for each color).

Accordingly, the line synchronization signal (discharge synchronization signal) generated based on the reference discharge timing signal is a signal that reflects the conveying amount of the sheet material P conveyed by the conveying drum 21 and its varying components.

<Arrangement of Nozzle Rows>

Figure 9:
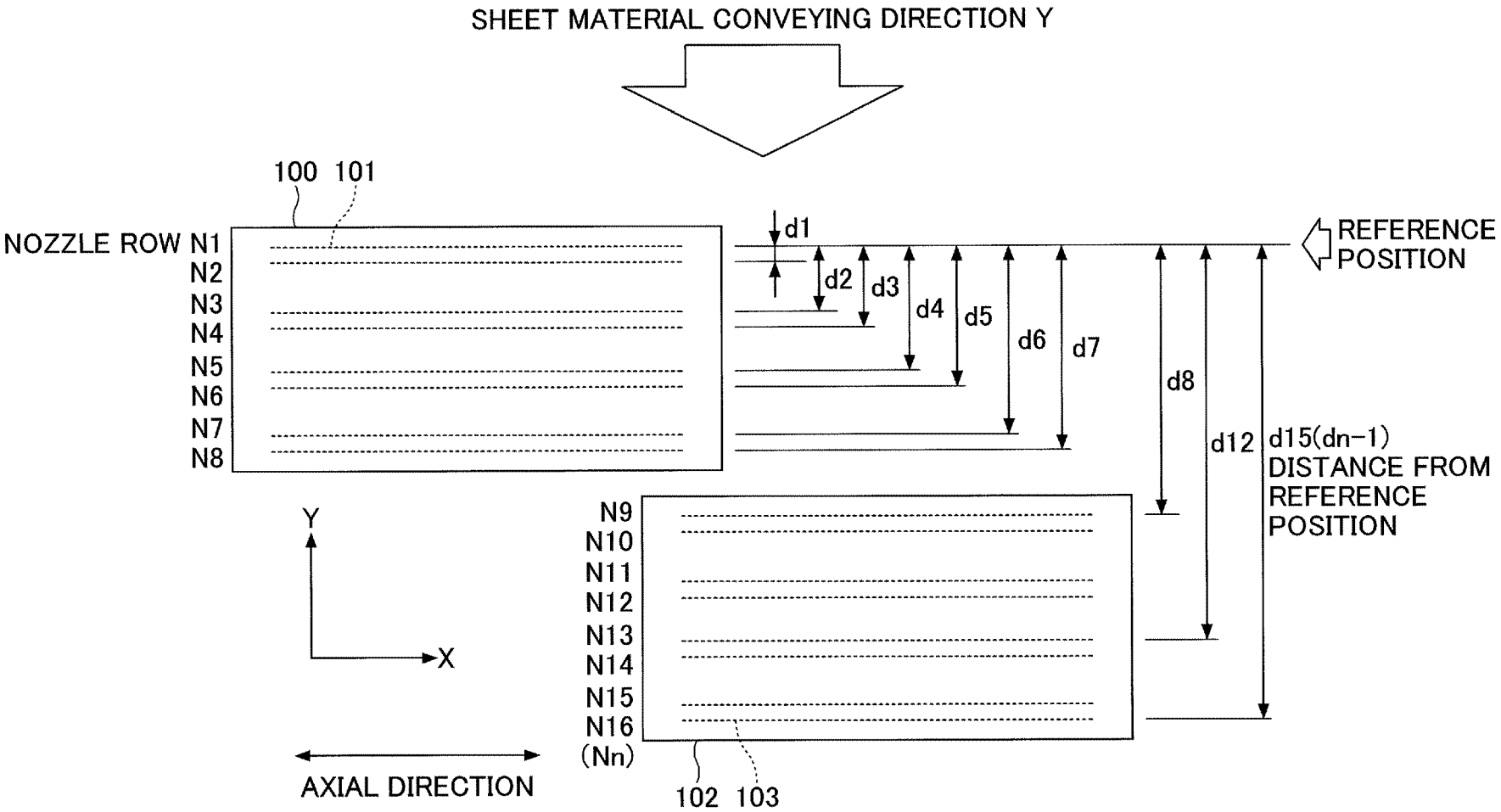
FIG. 9 is a diagram illustrating a part of an example of a bottom surface of a head unit configuration according to an embodiment.

FIG. 9 is a bottom view illustrating an example of a bottom surface of a head unit configuration according to the present embodiment. That is, FIG. 9 illustrates a part of the head unit 23 described in FIG. 2 in more detail when viewed from the bottom.

The sheet material P is conveyed from the top to the bottom in FIG. 9. The head 100 includes a plurality of nozzles arranged in parallel with the top surface of the head (in the X direction) (hereinafter referred to as the nozzle row 101), and in the present embodiment, eight lines of nozzles are arranged in one head. A head 102 is one of the heads positioned in a staggered manner, and eight rows of nozzles 103 are arranged in the head 102.

The distances in the Y direction with respect to the respective nozzle rows are illustrated from d1 to d15 for each nozzle row with reference to the nozzle row positioned closest to the top surface (in the drawing, side surface physically) of the head 100 of FIG. 9. This value is manufactured with a unique value for each nozzle row, but the value also includes manufacturing errors.

In this example, because 16 nozzle rows are present in the head unit in the conveying direction, the nozzle rows are N1 to N16, and the nozzle spacing is d1 to d15. However, when n (n is a natural number) nozzle rows are provided in the head unit, the distance from the reference position of the nozzle rows N2 to Nn (nozzle row distance) when the nozzle row N1 is used as the reference for the head unit is d1 to d(n−1).

The above-described line synchronization signal becomes a discharge timing for each nozzle disposed in the X direction of the same nozzle row illustrated in FIG. 9, and becomes a formation unit (one pixel) in the Y direction of an image formed on the sheet material P.

Figure 10:
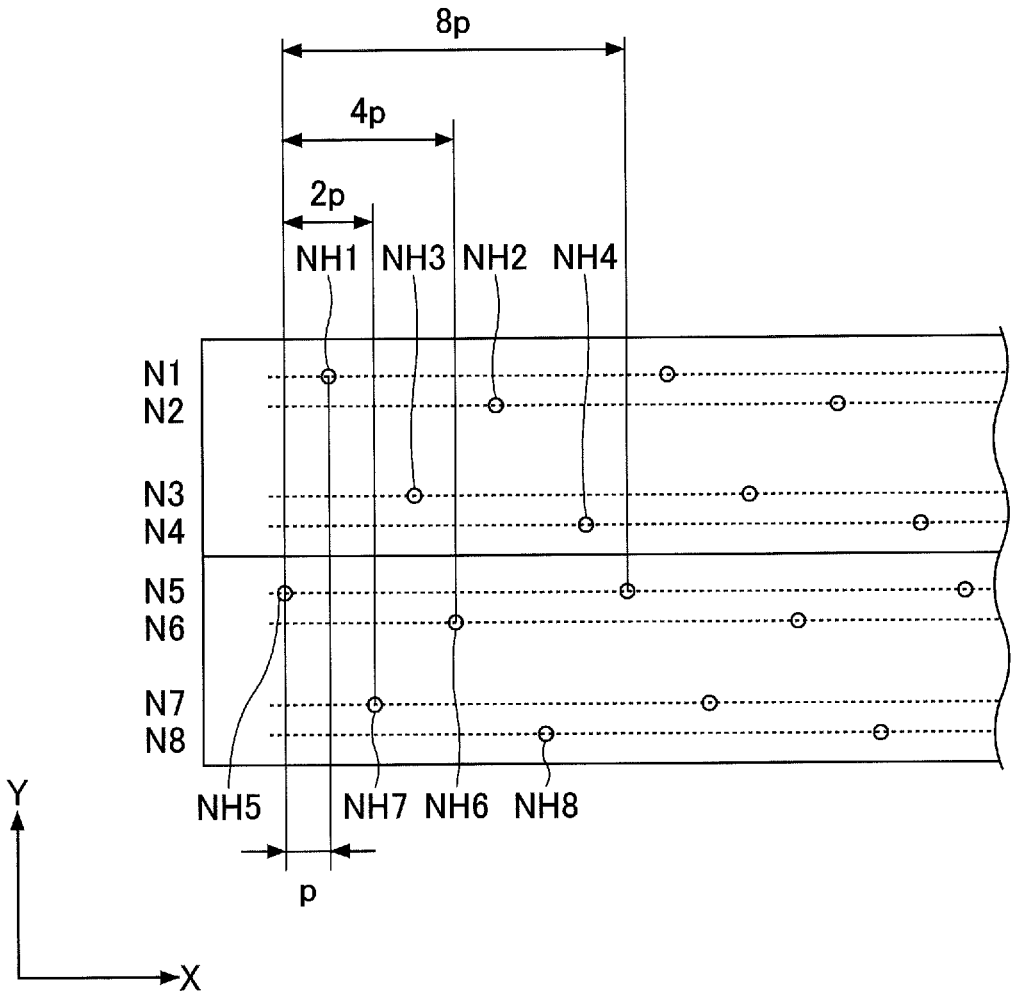
FIG. 10 is an enlarged view of a part of a bottom surface of an example of a drawing head.

FIG. 10 is an enlarged view of the bottom surface of the head 100 of FIG. 9. Nozzles NH1 to NH8 are provided in the eight nozzle rows N1 to N8, respectively, and are arranged in order and offset to each other in the X direction. According to this configuration, because the distance between the adjacent heads in the X direction is arranged accurately at a distance of p, the discharge to the sheet material is equally spaced in the X direction and high accuracy is maintained. By arranging the nozzle in this manner, the discharge distance in the X direction can be narrowed in pitch while maintaining the necessary physical distance of the nozzle.

<Generation of Nozzle Row Sub-Scanning Gate Signal (Nozzle Row Timing Signal)>

Figure 11:
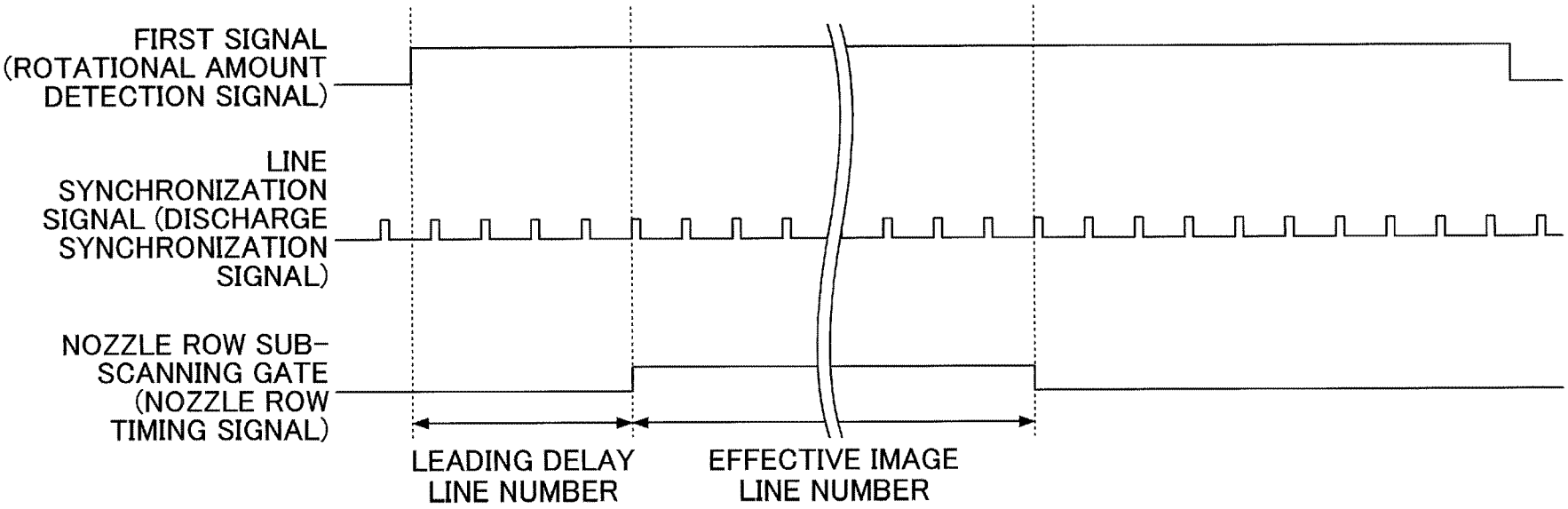
FIG. 11 is an explanatory diagram illustrating generation of a nozzle row sub-scanning gate signal from a rotational amount detection signal and a line synchronization signal.

FIG. 11 illustrates the generation of the nozzle row sub-scanning gate signal (nozzle row timing signal) using the first signal (rotational amount detection signal) and the line synchronization signal (discharge synchronization signal). The nozzle row sub-scanning gate signal is generated in eight nozzles per nozzle row as described in FIG. 9, that is, eight nozzles per head. FIG. 11 illustrates the formation of one of them.

In FIGS. 5 and 11, the nozzle row sub-scanning gate generator 504 receives the first signal (rotational amount detection signal), and from its rise, starts counting an H signal of the line synchronization signal (discharge synchronization signal), and converts the nozzle row sub-scanning gate signal to H (High, active) at the timing when the line synchronization signal converts to H and the count value equals the number of the leading delay lines. Then, the H of the nozzle row sub-scanning gate signal is converted to L (Low, inactive) at the timing when the count value of the line synchronization signal equals the number of the effective image lines and the line synchronization signal turns to H.

<Set of Delay Depending on Nozzle Row>

Figure 12:
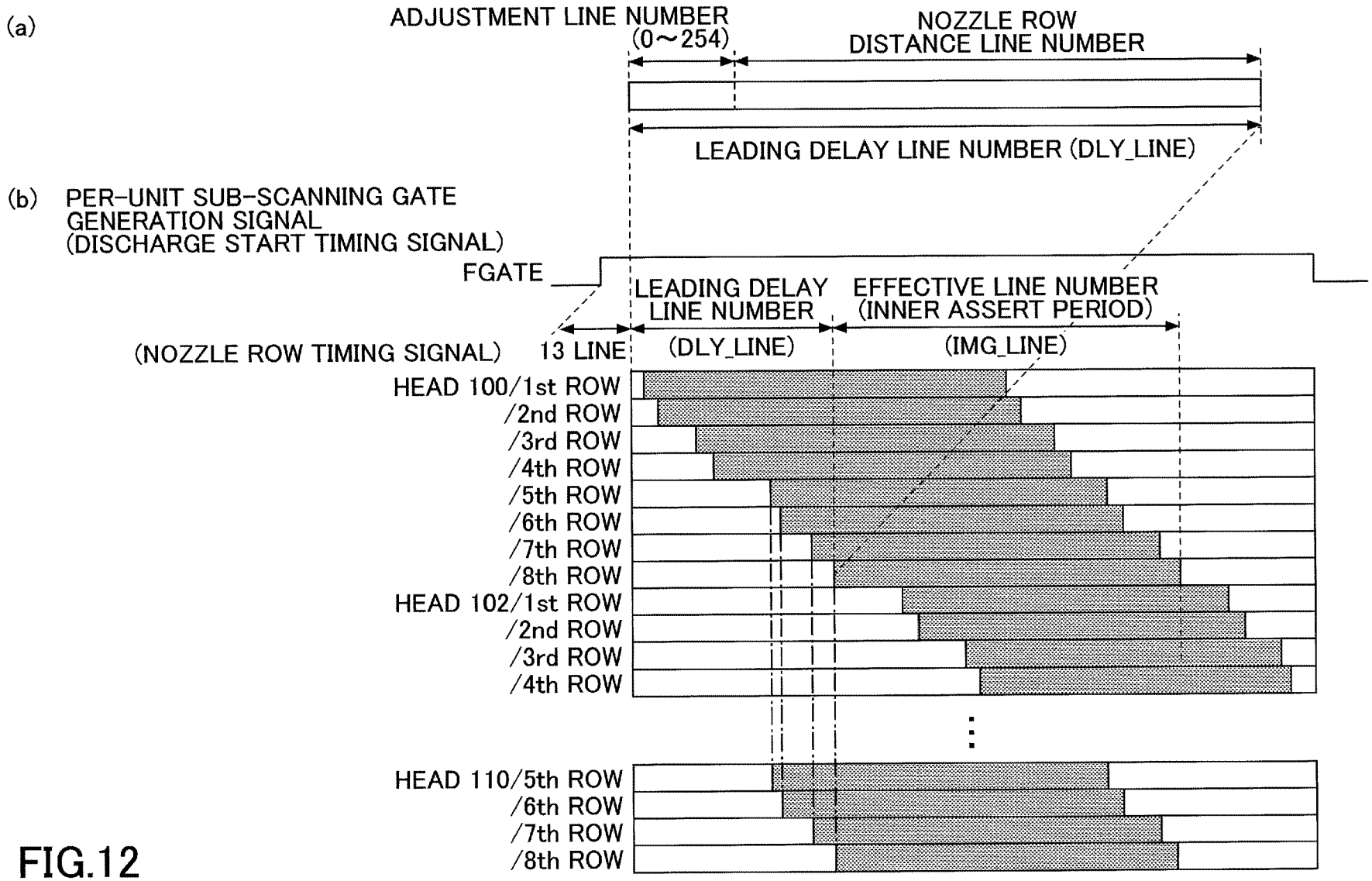
FIG. 12 is an explanatory diagram of a breakdown of a number of leading delay lines and an explanatory diagram of a timing signal for each nozzle row with respect to two heads adjacent to each other in a staggered arrangement.

FIG. 12 illustrates a breakdown of the number of leading delay lines and an example of reflection on the nozzle row sub-scan gate signal. The number of leading delay lines is a sum of the number of nozzle row distance lines and the number of adjustment lines described in FIG. 9. The number of nozzle row distance lines is unique for each nozzle row.

As illustrated in FIG. 9, in the head 100, the distance between the nozzle rows N1 and N2 and the distance between the nozzle rows N2 and N3 are different. Therefore, the number of nozzle row distance lines is set depending on the actual distance between the nozzle row N1 and another nozzle row. For example, in the nozzle row N2, because the nozzle row distance from the nozzle row N1 is d1, when the pulse of the line synchronization signal corresponding to the distance d1 is 2 pulses, the number of nozzle row distance lines is 2 pulses. In the nozzle row N3, for example, when the nozzle row distance is d2 and the pulses of the line synchronization signal corresponding to the distance d2 is 6 pulses, the number of nozzle row distance lines is 6 pulses.

The number of adjustment lines is a value that considers the manufacturing error of the nozzle row position of each head (head unit), and is determined by setting the measured value after manufacture and then regularly correcting the measured value.

Figure 13:
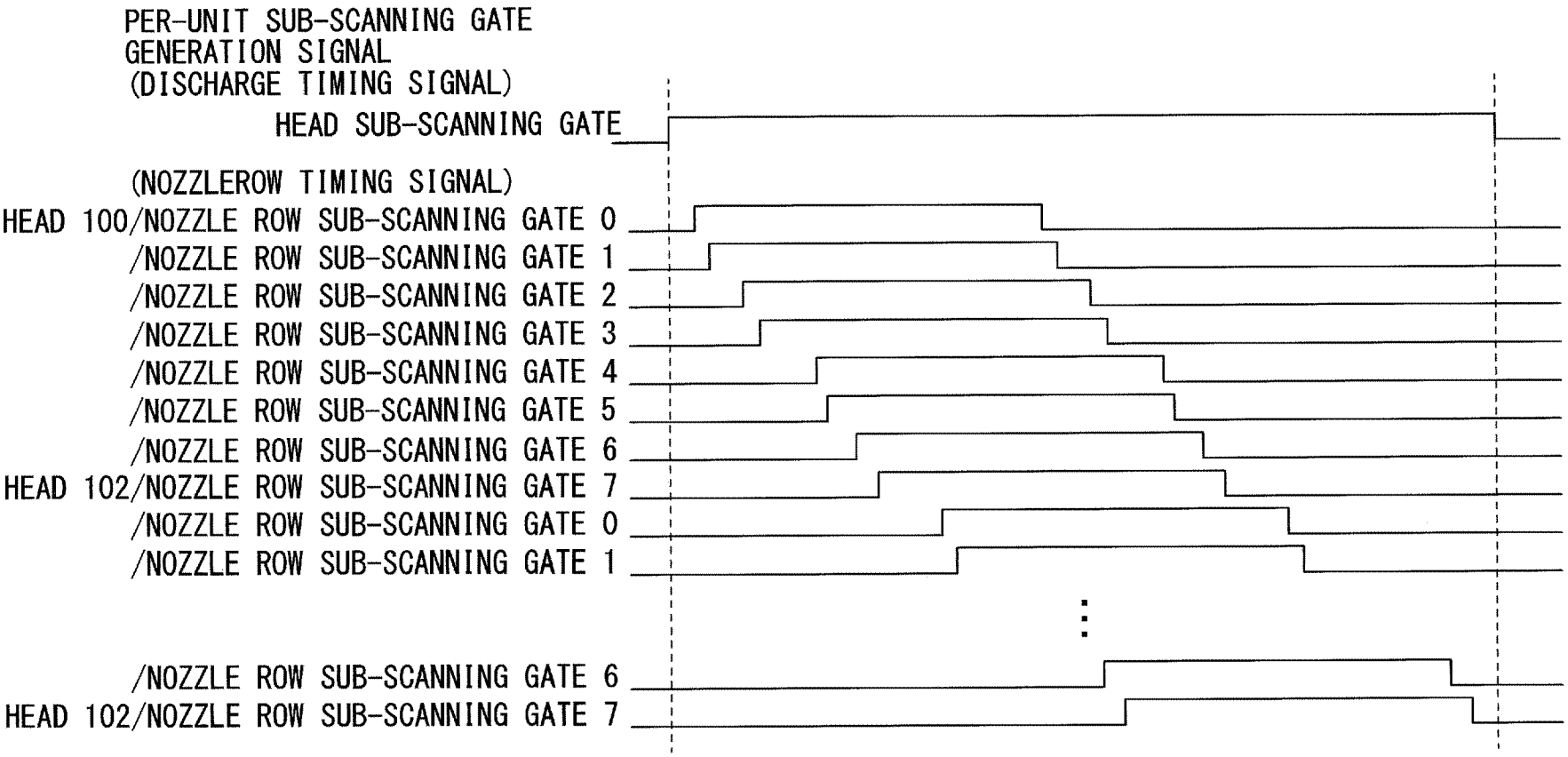
FIG. 13 is an explanatory diagram illustrating a timing chart reflected on H and L of a nozzle row sub-scanning gate signal.

Specifically, as illustrated in FIGS. 12 and 13, the timing control for each nozzle row corresponds to a configuration example of the head unit including two rows of heads each having eight rows of nozzles as illustrated in FIG. 9. In the timing control, in response to the enable signal (H) of the head sub-scanning gate FGATE, and after the head delay line from then, the enable signal of the FGATE for each nozzle row is started.

In addition, the signal generated to keep enabled (see the gray period in FIG. 12 (*b*)) for a period of effective line number is made the nozzle row FGATE.

The ink is discharged during this enabling period. The image is formed on the sheet by timing control with each head delay line for each nozzle row.

FIG. 12(*b*) illustrates an example in which the nozzle row of the first row of the head 100 on the downstream side in the conveying direction is out of the reference position, and the number of nozzle row distance lines is not zero at the leading row. However, when the leading nozzle row of the head is set to a reference position, the number of the nozzle row distance lines or the number of adjustment lines is set to zero.

Further, when the head illustrated in FIG. 9 zigzags as illustrated in FIG. 2, the head 100, the head 110, and the head 120, the head 102, the head 112, and the head 122 are provided at substantially equal positions in the Y direction. Therefore, the number of nozzle row distance lines in the number of nozzle head delay lines is set to the same number of lines in respective nozzle rows of the head 100, respective nozzle rows of the head 110, respective nozzle rows of the head 120, respective nozzle rows of the head 102, respective nozzle rows of the head 112, and respective nozzle rows of the head 122, as illustrated by dashed-dotted lines in FIG. 12 (*b*).

In FIG. 12 (*b*), the range of the "number of leading delay lines" indicates the period of the number of leading delay lines for the head 100 (110, 120) on the downstream side in the conveying direction for discharging ink to the sheet material P. Because the positions in the Y direction are different and because the number of leading delay lines for each nozzle row N9 to N16 provided in the head 102 (112, 122) on the upstream side of the sheet material P in the conveying direction is a number of lines corresponding to the nozzle distances d8 to d15 in FIG. 9, a period is set longer than the number of leading delay lines for the head 100 (110, 120).

FIG. 13 illustrates two heads adjacent to each other in a staggered arrangement for each nozzle row. The rise of each nozzle row gate signal is determined primarily by the nozzle row distance (d1 to d (n−1)) of the first delay line number. This indicates a timing when the reference position of the first signal rise, that is, the leading end of the sheet material P reaches the nozzle line at the top of the head, and the conveying period from the reference position to each nozzle row indicates the rise of each nozzle row sub-scanning gate (nozzle row timing signal).

In addition, each nozzle row discharges ink at the timing of the line synchronization signal H during the H period of each nozzle row sub-scanning gate. As described above, by considering the conveying period to each nozzle row and creating the discharge start timing for each nozzle row, the image formed by the eight nozzle rows can be positioned at the same position in the sub-scanning direction (the axial direction of the drum). Here, as previously described, the gate signal in this example becomes H for a period of a sum of a period corresponding to the length of the sheet material P in the sub-scanning direction, a period corresponding to the length of the head, and a period during which the adjustment portion is conveyed. The H-period corresponds to the size of the sheet material P such as B1 and B2.

Also, in a multi-page job, the gate signal is repeated each time the sheet material is conveyed and the printing is performed. A continuous roll of sheet material may be also applied, in which case the gate remains H until the printing job is completed, that is, during the discharge period.

<Flow Chart>

Figure 14:
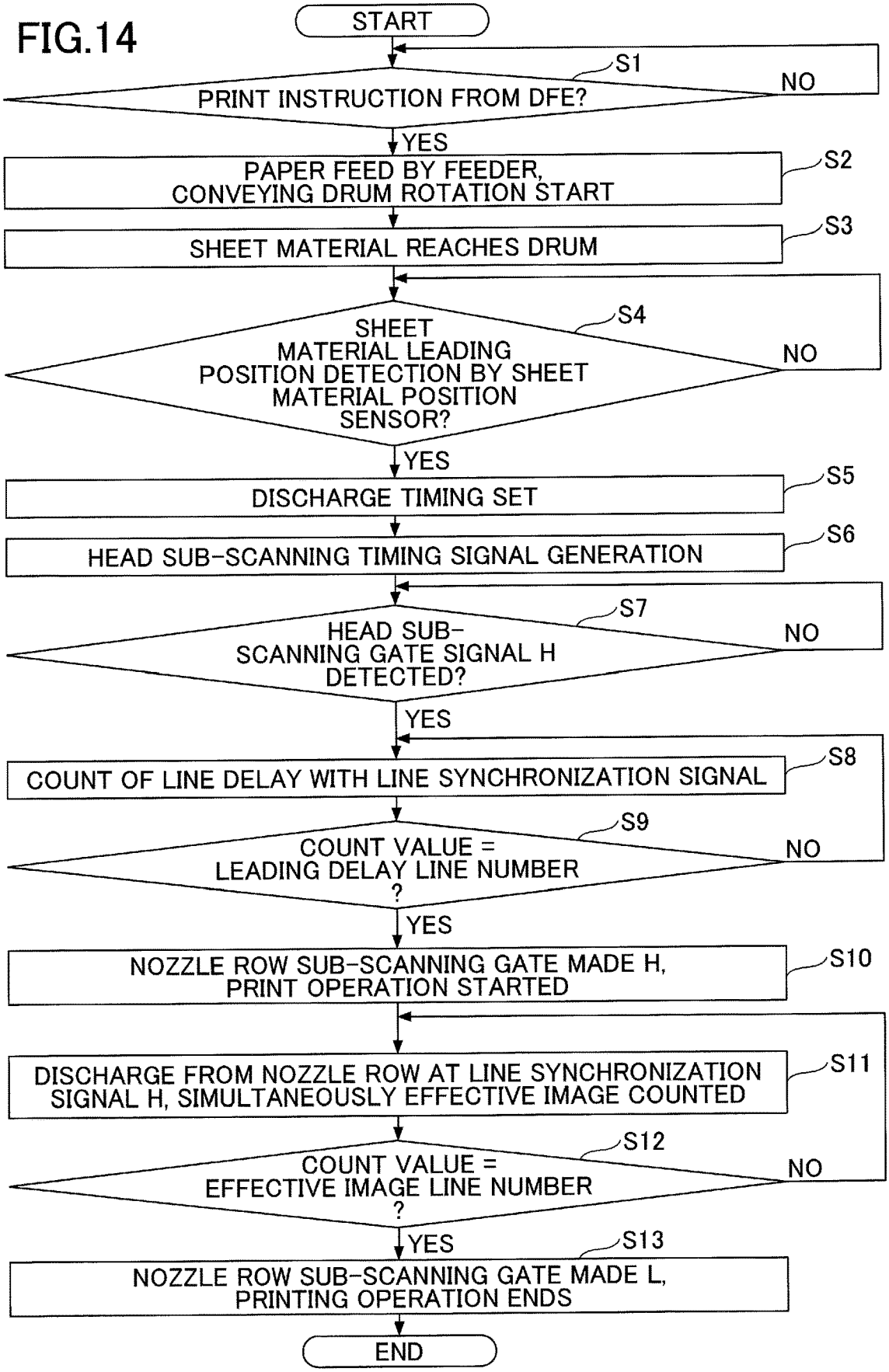
FIG. 14 is a flowchart illustrating a signal flow.

FIG. 14 illustrates a flow of control of the above series of signals.

First, when the instruction to start printing is issued from the DFE 2 in S1, the feeding device 12 delivers and conveys the sheet material P in S2, and the conveying drum 21 starts to rotate.

In S3, when the sheet material P is transferred to the conveying drum 21 by the transfer drum 24, the suction device 26 starts suctioning the sheet material P, and the conveying drum 21 conveys the sheet material P by rotating.

From when the sheet material position sensor 220 detects the leading end of the sheet material P (S4), the head sub-scanning gate signal generator 501 counts the output pulse (rotational amount detection signal) of the first encoder 201 in S5.

When the count reaches a predetermined count value, the head sub-scanning gate signal generator 501 determines the discharge start timing (the start timing of the head sub-scanning gate) for each color from each discharge unit 23 (S5), and the head sub-scanning gate signal generator 501 generates a head sub-scanning timing signal (the head sub-scanning gate signal) (S6).

Then, the head sub-scanning gate signal H is detected (S7), and the nozzle row sub-scanning gate generation unit 504 counts a delay line with the line synchronization signal (S8).

The count of S8 continues until reaching the number of leading delay lines, and when the count value equals the number of leading delay lines (S9), the nozzle row sub-scanning gate is turned to H (S10).

On this occasion, the head drive controller 505 transmits the discharge data to the discharge unit 23 at a time when the nozzle row sub-scanning gate is H and the line synchronization signal is H, and the discharge unit 23 starts the printing operation for forming an image on the sheet by discharging ink from the nozzle row based on the discharge data.

At the same time, the nozzle row sub-scanning gate generator 504 counts the effective image at the timing of the line synchronization signal H (S11).

In S11, the discharge operation and the count of the number of effective pixels continue until the count value equals the number of effective image lines. Then, the count value equals the number of effective image lines (S12); the nozzle row sub-scanning gate is set to L (S13); the printing operation ends; and the flow ends.

As described above, in the present disclosure, by individually controlling the discharge timing of each nozzle row, the arrangement distance between the nozzles can be obtained, which is likely to facilitate manufacture of the head and to improve a yield of the head manufacturing. It also has the effect of forming a dense image with a fine pitch.

As described above, the image forming apparatus of the present disclosure generates a nozzle row timing signal indicating the timing of the discharge of ink for each nozzle row based on information on a distance between nozzle rows, a conveying speed (conveying amount), and a discharge position. Therefore, it is possible to prevent the deterioration of image quality in various head configurations.

<Modification Example of Head Unit>

Figure 15:
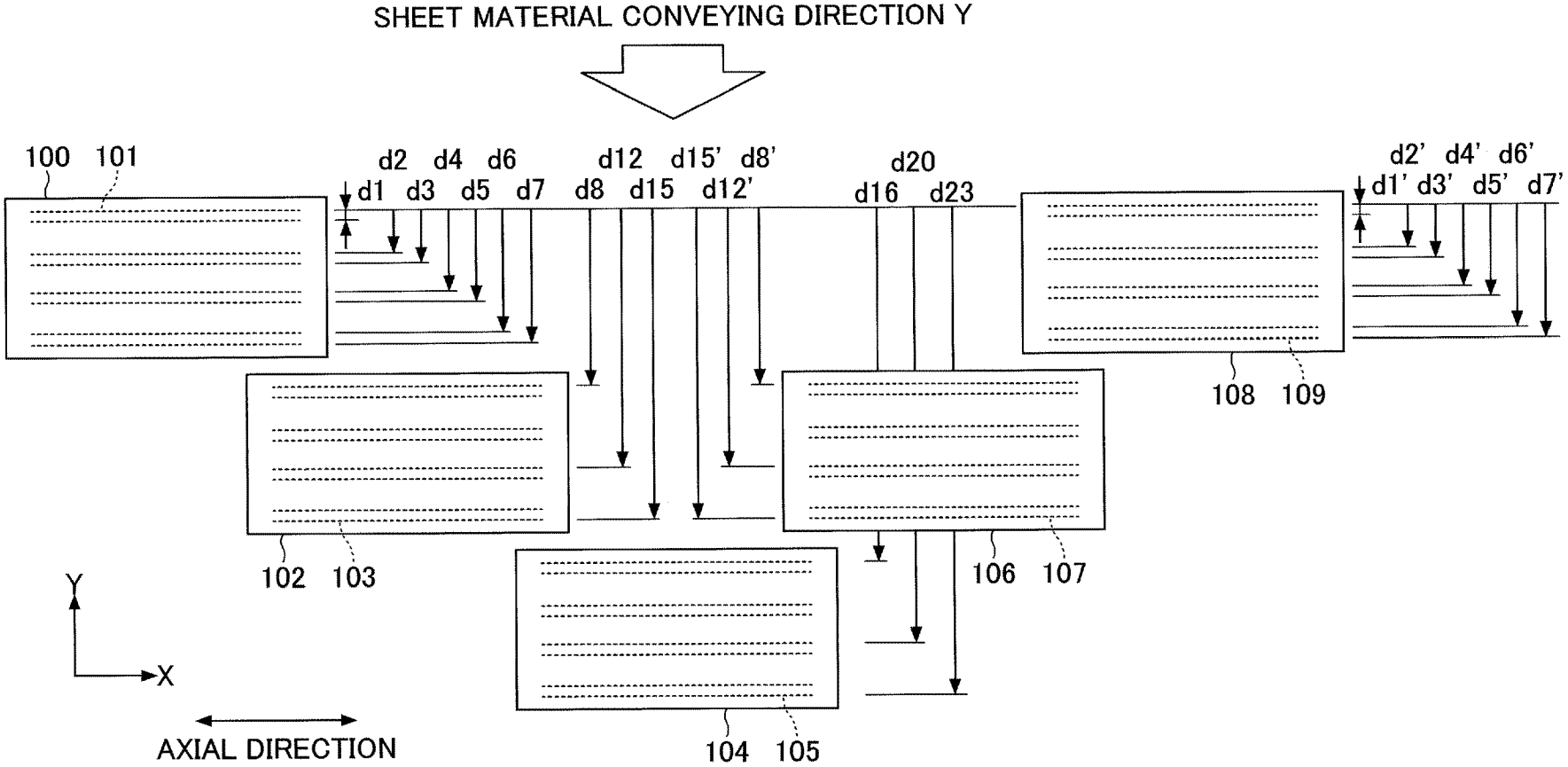
FIG. 15 is another configuration example of a discharge unit including three heads and five heads arranged in a Y direction and an X direction, respectively.

FIG. 15 is an example in which three head arrangements in the Y direction and five heads in the X direction are arranged in the head unit. According to an embodiment of the present disclosure, for such an arrangement of each nozzle row, the Y-direction distance can be set to a unique value for each nozzle row; the manufacturing error can be set for each nozzle row; and the nozzle row gate signal is generated, thereby forming the image at the same position in the sub-scanning direction.

More specifically, as illustrated in FIG. 15, the head 100 and the head 108, the head 102 and the head 106 are provided at substantially the same positions in the Y direction. Thus, in the number of nozzle head delay lines, the number of nozzle row distance lines (see FIG. 12(*b*)) is set to the same number of lines in each nozzle row of head 100 and each nozzle row of head 108, and in each nozzle row of head 102 and each nozzle row of head 106.

However, errors may occur in the positions of the nozzle rows of heads 100 and 108, and head 106 depending on the manufacturing location. Thus, for example, the positions of the nozzle rows at the top end of FIG. 15 of the head 100 and the head 108 may be considered to be equal, and the distance from the reference positions of the other nozzles may be set to different values for d1 to d7 and d1' to d7', and for d8 to d15 and d8' to d15', while considering dimensional errors during the manufacture. By setting a value specific to the nozzle for each head, the accuracy of the discharge position can be improved.

The number of nozzle rows in the head is optional and can be 10 rows or 2 rows in addition to 8 rows. That is, in the head unit (the discharge unit 23), a plurality of heads including x nozzle rows in the conveying direction is arranged in a row in the conveying direction, and is arranged intermittently in the axial direction, which causes n nozzle rows to be present in the head unit in the conveying direction. Then, the ends of the nozzle rows between adjacent heads in the axial direction of the plurality of heads overlap with each other in the axial direction and are arranged in a staggered shape so as to be at different positions in the conveying direction.

In this manner, the present embodiment can be applied to various head arrangements and various numbers of nozzle rows, and can be applied to flexible head arrangement and nozzle row arrangement.

Thus, in the image forming apparatus, even in a configuration in which several nozzle rows extending in the axial direction are disposed in the head unit in the conveying direction, the discharge position accuracy can be increased and the deterioration of the image quality can be prevented.

Further, as illustrated in FIGS. 12 to 13, the accuracy of the discharge position can be further increased by adjusting the nozzle row position in each head using an adjustment line that is a value considering the manufacturing error of the nozzle row position.

Second Embodiment

Figure 16:
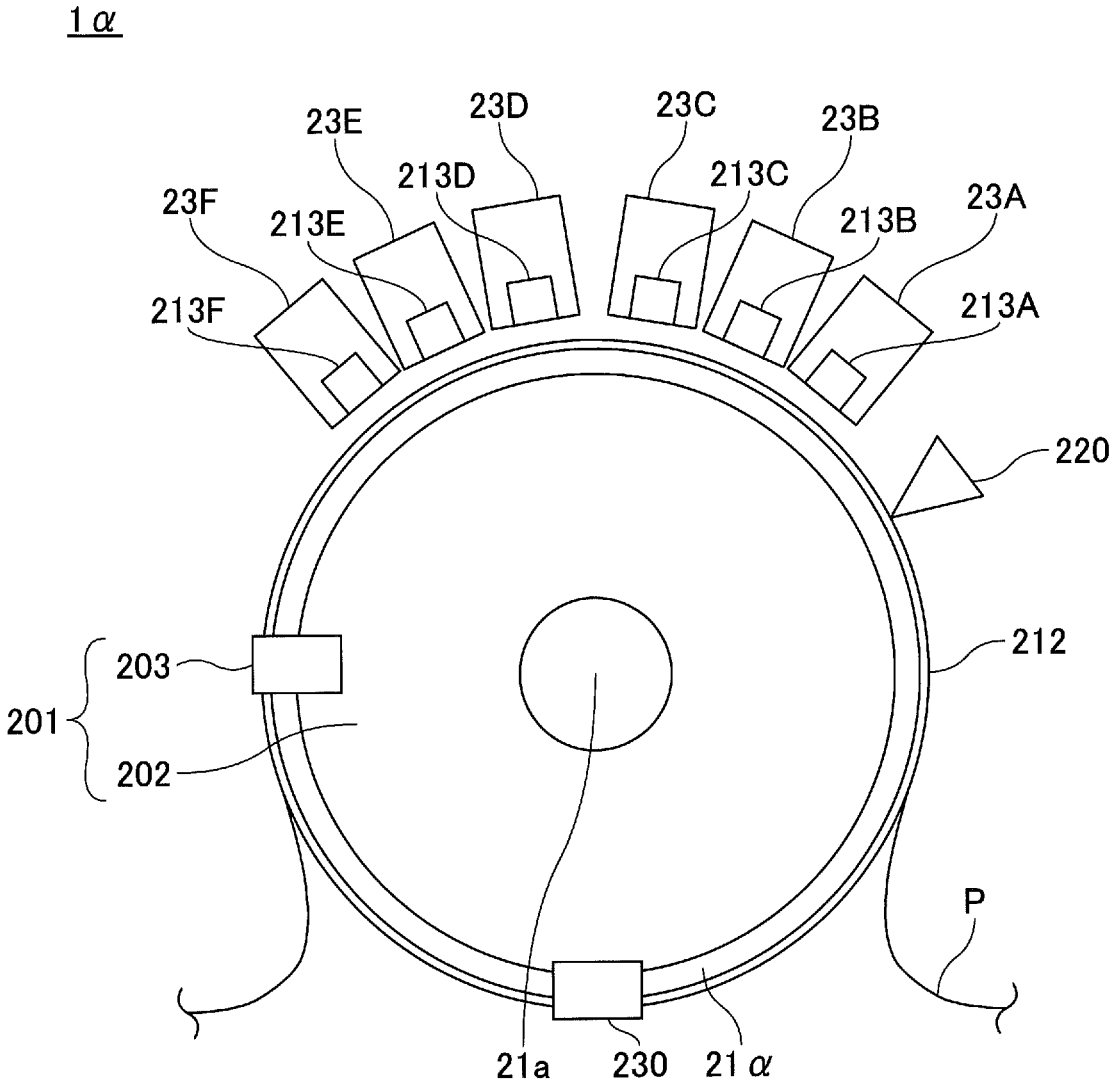
FIG. 16 is a schematic front view of an image forming apparatus according to a second embodiment of the present disclosure.

Next, an image forming apparatus according to a second embodiment including a liquid discharge groove disposed in a conveying drum will be described with reference to FIGS. 16 to 19. FIG. 16 is a front view schematically illustrating an image forming apparatus 1α according to a second embodiment of the present disclosure.

As illustrated in FIG. 16, in the present exemplary embodiment, a liquid discharge groove 230 is disposed in a conveying drum 21*a* in comparison with the image forming apparatus 1 illustrated in FIG. 1. In the first embodiment, the signal is controlled for timing setting of the discharge timing for forming the image. However, in the present embodiment, in addition to setting of the discharge timing for forming the image, in order to prevent clogging of the nozzle and to return the meniscus of the nozzle to the normal state, control of the signal is performed for timing setting of discharging (empty discharge, forced discharge) a large amount of ink that does not contribute to the image formation at the timing when the discharge unit head 23 faces the liquid discharge groove 230 of the drum between pages.

Figure 17:
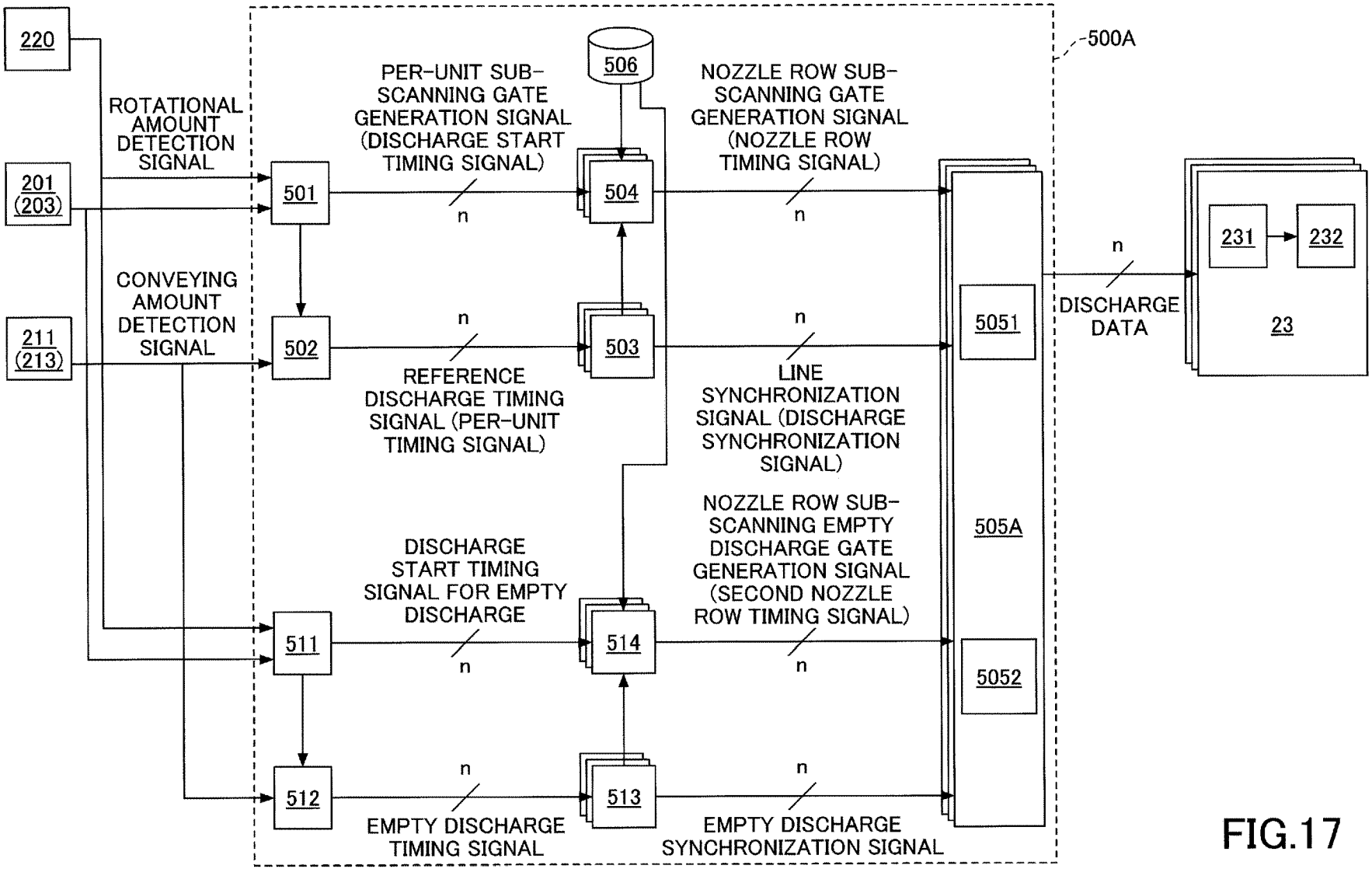
FIG. 17 is a detailed block diagram illustrating signal generation and discharge control according to a second embodiment.

FIG. 17 illustrates a block diagram for implementing the configuration of FIG. 16. In addition to the configuration illustrated in FIG. 6, a head sub-scanning empty discharge gate signal generator 511, a second reference discharge timing generator 512, a second line synchronization signal generator 513, and a nozzle row sub-scanning empty discharge gate generator 514 are added to the image converter 500A.

The head sub-scanning empty discharge gate signal generator 511 counts the output pulses that are the first signal (rotational amount detection signal) from the first encoder 201 and determines the discharge start timing for empty discharge when the detection result of the sheet material position sensor 220 is in a state of detecting the leading end position of the sheet material P. The timing is determined for each color. The head sub-scanning empty discharge gate signal generator 511 generates a discharge start timing signal for empty discharge for each color, that is, for each discharge unit 23.

The discharge start timing signal for empty discharge becomes H when the respective discharge unit 23 reaches a position facing the liquid discharge groove 230, and the discharge start timing is determined. This discharge start timing signal for empty discharge is generated for each color, that is, generated for each discharge unit 23 so as to become H at a timing when each discharge unit 23 reaches the liquid discharge groove 230.

The second reference discharge timing generator 512 generates a discharge timing after the discharge is performed at the discharge start timing determined by the head sub-scanning empty discharge gate signal generator 511 based on the output pulse (conveying amount detection signal) that is the second signal of the second encoder 211. The discharge timing is generated for each color.

The second line synchronization signal generator 513 is a second synchronization signal generator that generates a line synchronization signal (an empty discharge synchronization signal) for defining the discharge timing for empty discharge for each nozzle row provided in the head of each discharge unit 23.

The nozzle row sub-scanning empty discharge gate generator 514 is a nozzle row timing generator that generates a nozzle row sub-scanning empty discharge gate signal (an example of a nozzle row timing signal for empty discharge) that is a gate signal for empty discharge depending on the discharge start timing and the number of lines of the effective image for each nozzle row disposed in the head. The nozzle row sub-scanning empty discharge gate signal generated by the nozzle row sub-scanning empty discharge gate generator 514 is a signal indicating a period for executing discharge for preventing clogging.

Discharge from each discharge unit 23 starts at the discharge start timing for empty discharge determined by the head sub-scanning empty discharge gate signal generator 511, counts at the discharge timing (empty discharge synchronization signal) generated by the second reference discharge timing generator 512 after starting the discharge, and causes ink to be discharged from the discharge unit 23 through the head drive controller 505A.

The head drive controller 505A includes an image data generator 5051 and an empty discharge data generator 5052. Similar to FIG. 6, the image data generator 5051 outputs discharge data for forming an image to the discharge unit 23 during a period when the nozzle row sub-scanning gate signal is H.

The empty discharge data generator 5052 outputs the empty discharge data for discharge to the liquid discharge groove 230 to the discharge unit 23 during a period when the nozzle row sub-scanning empty discharge gate signal is H.

Thus, by providing the respective sub-scanning gate signals of the image formation and the empty discharge for respective colors and controlling the timing, the discharge unit 23 is caused to perform the discharge for the image formation and the discharge to the next liquid discharge groove 230 by instructing the timing.

Figure 18:
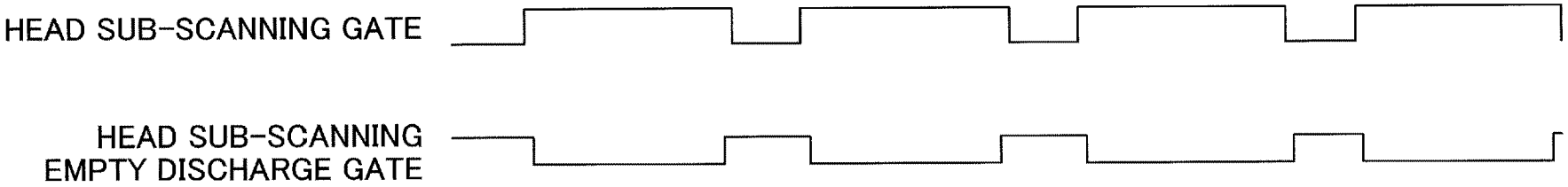
FIG. 18 is an explanatory diagram illustrating a timing of a head sub-scanning gate for image formation and a head sub-scanning empty discharge gate for empty discharge according to a second embodiment.

FIG. 18 illustrates the timing of the sub-scanning gate of image formation and discharge (empty discharge) to the liquid discharge groove 230 in the configuration including the liquid discharge groove 230.

As illustrated in FIG. 18, the head sub-scanning gate signal for the sheet material P, which shows the image forming possible period, and the head sub-scanning empty discharge gate signal, which shows the empty discharge possible period for the liquid discharge groove 230, are signals in which the periods of H and L are reversed.

Figure 19:
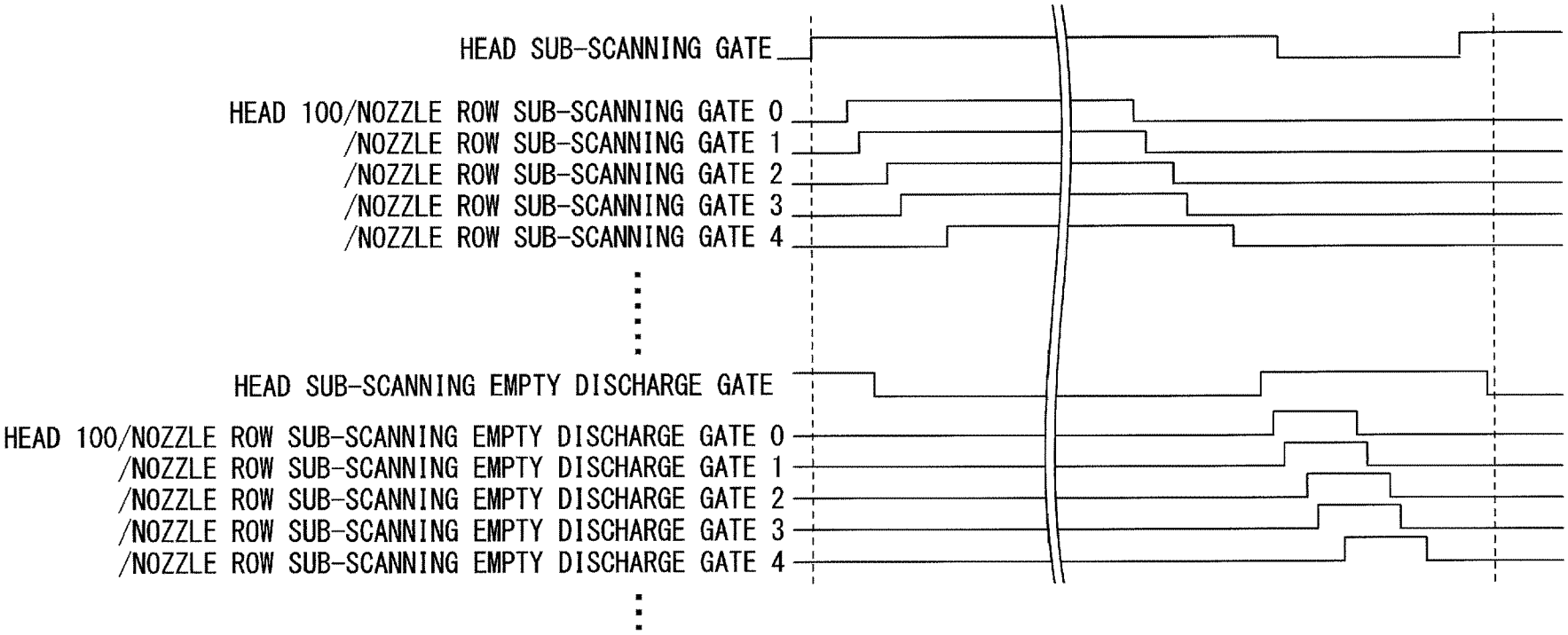
FIG. 19 is a timing chart explaining a timing of image formation and empty discharge by enlarging a part of FIG. 18 and adding each nozzle row sub-scanning gate of each head.

FIG. 19 is a diagram enlarging a portion of FIG. 18 to explain the timing of image formation and discharge into the liquid discharge groove 230 while adding each nozzle row sub-scanning gate of each head.

The signal generation method that receives the rise of the head sub-scanning empty discharge gate and that generates the sub-scanning empty discharge gate for each nozzle row in the nozzle row empty discharge gate generator 514 is the same as the signal generation method in the nozzle row sub-scanning gate generator 504 illustrated in FIGS. 12 to 14.

As described above, by generating the nozzle row sub-scanning gate and the nozzle row sub-scanning empty discharge gate, the image formation on the sheet material P and the empty discharge other than the printing period for preventing clogging of the nozzle can be compatible with each other.

In the present embodiment, by performing the empty discharge of the ink to the liquid discharge groove, clogging of the nozzle can be prevented.

Third Embodiment

Figure 20:
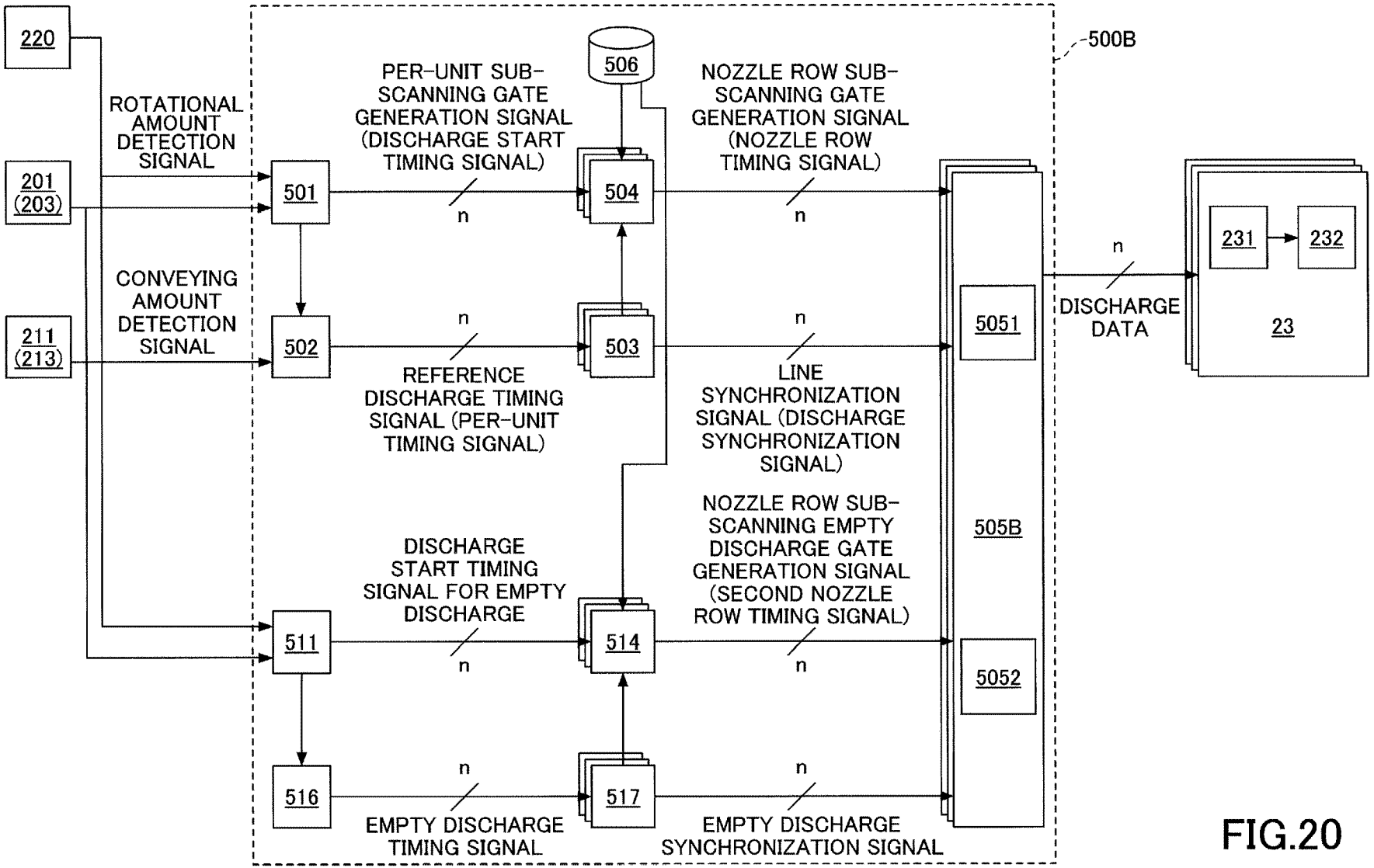
FIG. 20 is a detailed block diagram illustrating signal generation and discharge control according to a third embodiment.

FIG. 20 is a detailed block diagram illustrating signal generation and discharge control according to a third embodiment.

The third reference discharge timing generator 516 generates a discharge timing at the discharge start timing determined by the head sub-scanning empty discharge gate signal generator 511, and generates a subsequent discharge timing by counting the internal clock output at any period and using a pulse signal that equals the desired count value. The timing is generated for each color.

The internal clock is input to each block although not illustrated, and is a clock that serves as a reference for logic circuits.

In the image converter 500B according to the present embodiment, by generating the discharge timing using the internal clock, the third reference discharge timing generator 516 does not need a sensor that receives the conveying amount detection signal to detect the start position of the head sub-scanning empty discharge gate, thereby reducing the cost.

The third line synchronization signal generator (the third synchronization signal generator) 517 generates a line synchronization signal (an empty discharge synchronization signal) for empty discharge based on a third reference timing signal having any cycle starting from the detected rotational amount detection signal.

Accordingly, in the present configuration example, because the conveying amount detection signal is not used as the detection information for discharging ink to the liquid discharging groove 230 (empty discharge), it is possible to prevent clogging of the nozzle by discharging the ink to the liquid discharging groove 230 while reducing the cost caused from the configuration.

Thus, according to the embodiments, in an image forming apparatus, even in a configuration including a nozzle row extending in the axial direction disposed in a head unit in the conveying direction, the discharge position accuracy can be increased, and deterioration of the quality of the image can be prevented.

Although the preferred embodiments have been described in detail above, various modifications and substitutions can be made to the embodiments described above without departing from the scope of the appended claims.

For example, although the embodiments described above illustrate an example of using the conveying drum 21 as a rotating conveying unit, the rotating conveying unit may be a circular or elliptical rotating belt that is rolled around a plurality of rollers.

For example, in the above-described embodiments, an image forming apparatus including a conveying apparatus according to the present disclosure has been described. However, the conveying apparatus according to the present disclosure can be broadly applied to an apparatus for discharging ink (liquid) including an image forming apparatus.

Here, the "image forming apparatus" includes a liquid discharge head or a liquid discharge unit that is a liquid discharge portion and drives the liquid discharge section to discharge the liquid. The devices for discharging liquids may include not only devices capable of discharging liquids to media to which liquids can be attached, but also units for feeding, conveying, and discharging media to which liquids can be attached, and other pre-treatment and post-treatment devices.

The aforementioned "recording medium" means a medium that liquids can at least temporarily adhere to, adhere to and then fix to, and adhere to and then permeate into. Examples of the recording medium include a medium to be recorded such as paper, recording paper, recording paper, film, cloth and the like, electronic components such as electronic boards, piezoelectric elements and the like, a medium such as a powder layer, an organ model, a test cell and the like, and include all media to which liquid adheres, as long as the medium is not specifically limited.

The material "that liquid can adhere to" may be a material that liquid can adhere to even temporarily such as paper, yarn, fiber, fabric, leather, metal, plastic, glass, wood, and ceramics.

Also, the "liquid" includes an ink, a processing liquid, a DNA sample, resist, a patterning material, a binder, a shaping liquid, or a solution and a dispersion liquid containing an amino acid, a protein, calcium, and the like.

In addition, the pressure generator used for each head of the "discharge head" is not limited. For example, a piezoelectric actuator (a laminated piezoelectric device may be used), a thermal actuator using an electrothermal conversion device such as an exothermic resistor, an electrostatic actuator consisting of a diaphragm and a counter-electrode and the like may be used.

In addition, the terms of the present application, such as image formation, recording, letter printing, image printing, printing, and molding, are all synonymous.

What is claimed is:

1. An image forming apparatus, comprising:

a rotational conveying unit including a gripping member configured to grip a recording medium, the rotational conveying unit being configured to convey the recording medium by rotating about a rotational axis while gripping the recording medium by the gripping member;

at least one head unit including n nozzle rows in a conveying direction perpendicular to an axial direction parallel to the rotational axis, each of the n nozzle rows including a plurality of nozzles each aligned as a nozzle row in the axial direction, each of the nozzles being configured to discharge an ink drop onto the recording medium, each of the n nozzle rows being arranged at a distance of d1 to d(n−1) from a predetermined reference nozzle row, wherein n is a natural number; and a circuit configured:

to detect a rotational amount of the rotational conveying unit and to output a rotational amount detection signal, to detect a conveying amount of the recording medium by the rotational conveying unit and to output a conveying amount detection signal, to generate a discharge synchronization signal based on the detected rotational amount detection signal and the detected conveying amount detection signal, to generate a nozzle row timing signal indicating a discharge timing from each of the n nozzle rows at a different timing for each of the n nozzle rows based on the distance of the d1 to d(n−1) and the discharge synchronization signal, the distance of the d1 to d(n−1) being arrangement information of the n nozzle rows in the at least one head unit, and to generate discharge data for each of the n nozzle rows based on the discharge synchronization signal and the nozzle row timing signal.

2. The image forming apparatus as claimed in claim 1, wherein the at least one head unit includes a plurality of head units, and the plurality of head units are arranged along the rotational direction so as to face an outer circumferential surface of the rotational conveying unit, each of the plurality of head units including a detection device, and wherein the circuit is configured:

to generate a per-unit timing signal for each of the plurality of head units based on the rotational amount detection signal, to generate a reference discharge timing signal for each of the plurality of head units from the per-unit discharge timing signal, depending on detection results of the per-unit discharge timing signal and the plurality of detection devices, and to generate the discharge synchronization signal by dividing the reference discharge timing signal.

3. The image forming apparatus as claimed in claim 2, wherein the circuit is configured to generate the nozzle row timing signal at a different timing for each of the n nozzle rows while the per-unit discharge timing signal in each of the head units is an enable signal, by delaying an adjustment line based on the arrangement information indicating the distance of the d1 to d(n−1) making the discharge synchronization signal as a unit and positions of the n nozzle rows of the head units.

4. The image forming apparatus as claimed in claim 1, wherein the purality of head units is configured to discharge a plurality of different color liquids, and whrein the per-unit discharge timing signal is a discharge timing signal for each color.

5. The composite material as claimed in claim 1, wherein the rotational conveying unit has a liquid discharge groove extending in a depth direction, and wherein the circuit is configured to generate an empty synchronization signal based on the detected rotational amount detection signal and the conveying amount detection signal, and further comprises:

a second nozzle row timing signal generator configured to generate a second nozzle row timing signal for empty discharge based on the distance of d1 to d(n−1), the empty discharge synchronization signal and the rotational amount detection signal, the second nozzle row timing signal indicating a period of time for performing the empty discharge, the empty discharge not contributing to image formation, and an empty discharge data generator configured to generate empty discharge data to implement the empty discharge based on the empty discharge synchronization signal and the second nozzle row timing signal.

6. The image forming apparatus as claimed in claim 1, wherein the rotational conveying unit has a liquid discharge groove extending in a depth direction, and wherein the circuit is configured:

to generate an empty discharge synchronization signal at any cycle by making the detected rotational amount detection signal as a starting point, and to generate a third nozzle row timing signal for empty discharge indicating a period of time for performing the empty discharge based on the distance of d1 to d(n−1), the empty discharge synchronization signal and the rotational amount detection signal, and further comprises an empty discharge data generator configured to generate empty discharge data based on the empty discharge synchronization signal and the third nozzle row timing signal.

7. The image forming apparatus, as claimed in claim 1, wherein the at least one head unit includes a plurality of head units each including x nozzle rows in the conveying direction, the x being a natural number, the plurality of head units being arranged in a row in the conveying direction and arranged intermittently in the axial direction such that the n nozzle rows are arranged in the conveying direction as a total, at least a part of the nozzle rows in each of the head units adjacent to each other in the axial direction overlapping in the axial direction, the plurality of head units being located at different positions in the conveying direction.

8. A signal control method in an image forming apparatus, comprising:

conveying a recording medium toward a head unit by rotating about a rotational axis while gripping the recording medium by a gripping member, the head unit including n nozzle rows in a conveying direction perpendicular to an axial direction parallel to the rotational axis, each of the n nozzle rows including a plurality of nozzles each aligned as a nozzle row in the axial direction, each of the nozzles being configured to discharge an ink drop onto the recording medium, each of then nozzle rows being arranged at a distance of d1 to d(n−1) from a predetermined reference nozzle row, wherein n is a natural number;

detecting a rotational amount of the rotational conveying unit and outputting a rotational amount detection signal;

detecting a conveying amount of the recording medium by the rotational conveying unit and outputting a conveying amount detection signal;

generating a discharge synchronization signal based on the detected rotational amount detection signal and the detected conveying amount detection signal, generating a nozzle row timing signal indicating a discharge timing from each of the n nozzle rows at a different timing for each of the n nozzle rows based on the distance of the d1 to d(n−1) and the discharge synchronization signal, the distance of the d1 to d(n−1) being arrangement information of the n nozzle rows in the at least one head unit, and generating discharge data for each of the n nozzle rows based on the discharge synchronization signal and the nozzle row timing signal.

9. A non-transitory computer-readable medium comprising computer program product arranged for performing, when executed on one or more processors, a method comprising steps of:

conveying a recording medium toward a head unit by rotating about a rotational axis while gripping the recording medium by a gripping member, the head unit including n nozzle rows in a conveying direction perpendicular to an axial direction parallel to the rotational axis, each of the n nozzle rows including a plurality of nozzles each aligned as a nozzle row in the axial direction, each of the nozzles being configured to discharge an ink drop onto the recording medium, each of then nozzle rows being arranged at a distance of d1 to d (n−1) from a predetermined reference nozzle row, wherein n is a natural number;

detecting a rotational amount of the rotational conveying unit and outputting a rotational amount detection signal;

detecting a conveying amount of the recording medium by the rotational conveying unit and outputting a conveying amount detection signal;

generating a discharge synchronization signal based on the detected rotational amount detection signal and the detected conveying amount detection signal, generating a nozzle row timing signal indicating a discharge timing from each of the n nozzle rows at a different timing for each of the n nozzle rows based on the distance of the d1 to d(n−1) and the discharge synchronization signal, the distance of the d1 to d(n−1) being arrangement information of the n nozzle rows in the at least one head unit, and generating discharge data for each of the n nozzle rows based on the discharge synchronization signal and the nozzle row timing signal.

* * * * *